US006814422B2

(12) United States Patent
Bruch et al.

(10) Patent No.: US 6,814,422 B2
(45) Date of Patent: Nov. 9, 2004

(54) METHOD OF SERVICING A PEN WHEN MOUNTED IN A PRINTING DEVICE

(75) Inventors: Xavier Bruch, Sant Cugat del Valles Barcelona (ES); Xavier Girones, Mora la Nova Tarragona (ES); Antoni Murcia, San Diego, CA (US); Christopher Taylor, Cely-en-Biere (FR); Ramon Vega, Sabadell Barcelona (ES)

(73) Assignee: Hewlett-Packard Development Company L.P., Houston, TX (US)

( * ) Notice: Subject to any disclaimer, the term of this patent is extended or adjusted under 35 U.S.C. 154(b) by 0 days.

(21) Appl. No.: 10/292,047

(22) Filed: Nov. 12, 2002

(65) Prior Publication Data

US 2003/0117455 A1 Jun. 26, 2003

Related U.S. Application Data

(62) Division of application No. 09/506,737, filed on Feb. 18, 2000, now Pat. No. 6,517,184.

(30) Foreign Application Priority Data

Feb. 19, 1999 (EP) ..... 99103276

(51) Int. Cl.[7] ..... B41J 2/165
(52) U.S. Cl. ..... 347/23; 347/19
(58) Field of Search ..... 347/14, 19, 23, 347/81, 10, 11, 12, 29, 30, 33, 35, 86; 400/74

(56) References Cited

U.S. PATENT DOCUMENTS 5,627,571 A 5/1997 Anderson et al.
6,089,695 A 7/2000 Takagi et al.
6,283,572 B1 * 9/2001 Kumar et al. ..... 347/19
6,517,184 B1 * 2/2003 Bruch et al. ..... 347/23

FOREIGN PATENT DOCUMENTS

| | | |
|---|---|---|
| EP | 0 348 234 | 12/1989 |
| EP | 0 556 011 | 8/1993 |
| EP | 0 863 004 | 9/1998 |
| JP | 2-3323 | 1/1990 |
| JP | 07256895 | 10/1995 |
| JP | 09099551 | 4/1997 |
| JP | 9-136433 | 5/1997 |

OTHER PUBLICATIONS

The Attached is a Machine Assisted Translation of JP 2–3323. Nishitami Jan. 8, 1990.

* cited by examiner

*Primary Examiner*—Shih-Wen Hsieh

(57) ABSTRACT

A method of servicing a pen comprising a printhead, having a plurality of nozzles, mounted in an inkjet printing device, comprising a servicing area and a drop detector comprising the following steps performing a drop detection on the printhead to check if any of the nozzles of the printhead are malfunctioning; storing the result of the more recent drop detection operation, together with the results of the previous drop detections to keep a history of the health status of each nozzle; deciding whether or not to execute a recovery service in the servicing area to attempt to recover the current malfunctioning nozzles, based on the more recent status of the nozzles and on the history of the health status of the nozzles.

6 Claims, 16 Drawing Sheets

METHOD OF SERVICING A PEN WHEN MOUNTED IN A PRINTING DEVICE

CROSS REFERENCE TO RELATED APPLICATION

This is divisional of application Ser. No. 09/506,737 filed on Feb. 18, 2000, now U.S. Pat. No. 6,517,184 which is hereby incorporated by reference herein.

FIELD OF THE INVENTION

The present invention relates to inkjet printing devices, and particularly although not exclusively to a method and apparatus for servicing a pen when mounted in a printing device.

BACKGROUND TO THE INVENTION

Inkjet printing mechanisms may be used in a variety of different printing devices, such as plotters, facsimile machines and inkjet printers, collectively called in the following as printers, to print images using a colorant, referred to generally herein as "ink." These inkjet printing mechanisms use inkjet cartridges, often called "pens," to shoot drops of ink onto a page or sheet of print media. Some inkjet print mechanisms carry an ink cartridge with an entire supply of ink back and forth across the sheet. Other inkjet print mechanisms, known as "off-axis" systems, propel only a small ink supply with the printhead carriage across the printzone, and store the main ink supply in a stationary reservoir, which is located "off-axis" from the path of printhead travel. Typically, a flexible conduit or tubing is used to convey the ink from the off-axis main reservoir to the printhead cartridge. In multi-color cartridges, several printheads and reservoirs are combined into a single unit, with each reservoir/printhead combination for a given color also being referred to herein as a "pen."

Each pen has a printhead that includes very small nozzles through which the ink drops are fired. The particular ink ejection mechanism within the printhead may take on a variety of different forms known to those skilled in the art, such as those using piezo-electric or thermal printhead technology. For instance, two earlier thermal ink ejection mechanisms are shown in U.S. Pat. Nos. 5,278,584 and 4,683,481, both assigned to the present assignee, Hewlett-Packard Company. In a thermal system, a barrier layer containing ink channels and vaporization chambers is located between a nozzle orifice plate and a substrate layer. This substrate layer typically contains linear arrays of heater elements, such as resistors, which are energized to heat ink within the vaporization chambers. Upon heating, an ink droplet is ejected from a nozzle associated with the energized resistor.

To print an image, the printhead is scanned back and forth across a printzone above the sheet, with the pen shooting drops of ink as it moves. By selectively energizing the resistors as the printhead moves across the sheet, the ink is expelled in a pattern on the print media to form a desired image (e.g., picture, chart or text). The nozzles are typically arranged in one or more linear arrays. If more than one, the two linear arrays are located side-by-side on the printhead, parallel to one another, and substantially perpendicular to the scanning direction. Thus, the length of the nozzle arrays defines a print swath or band. That is, if all the nozzles of one array were continually fired as the printhead made one complete traverse through the printzone, a band or swath of ink would appear on the sheet. The height of this band is known as the "swath height" of the pen, the maximum pattern of ink which can be laid down in a single pass.

The orifice plate of the printhead, tends to pick up contaminants, such as paper dust, and the like, during the printing process. Such contaminants adhere to the orifice plate either because of the presence of ink on the printhead, or because of electrostatic charges. In addition, excess dried ink can accumulate around the printhead. The accumulation of either ink or other contaminants can impair the quality of the output by interfering with the proper application of ink to the printing medium. In addition, if colour pens are used, each printhead may have different nozzles which each expel different colours. If ink accumulates on the orifice plate, mixing of different coloured inks (cross-contamination) can result during use. If colours are mixed on the orifice plate, the quality of the resulting printed product can be affected. For these reasons, it is desirable to clear the printhead orifice plate of such contaminants and ink on a routine basis to prevent the build up thereof. Furthermore, the nozzles of an ink-jet printer can clog, particularly if the pens are left uncapped in an office environment.

In an off-axis pen, life goal is on the order of 40 times greater than a conventional non off-axis system, e.g. the printhead cartridges available in DesignJet® 750C color printers, produced by Hewlett-Packard Company, of Palo Alto, Calif., the present assignee. Living longer and firing more drops of ink means that there are greater probability that the printer print quality degrade and/or deviate along life. This requires finding better ways to keep functional and stable our printheads during long periods and large volumes of ink fired.

In U.S. Pat. No. 5,455,608 it is described how a printer may adjusts servicing of the pen based on the result of the current drop detection step only. Before starting a plot these printers perform a drop detection on all the pens to detect if there are any non-firing nozzles ("nozzles out"). If a single nozzle out is detected in a pen, the printer triggers a so called automatic recovery servicing process for servicing the malfunctioning pen to recover the malfunctioning nozzle(s).

This process includes a sequence of 3 nozle servicing or clearing procedures of increasing severity which are performed in sequence so long as some of the nozzles of the printhead fail to fire ink drops pursuant to ink firing pulses provided to the printhead or until all of the procedures have been is performed.

At the end of each of these procedures a new drop detection is performed on the pen, to verify if the pen is fully recovered. If, according to the current result of the drop detection, it is not, the subsequent servicing procedure is performed. If, at the end of the 3 functions, the pen is still not fully recovered (i.e. at least one nozzles is still out) the user is reported to replace the pen or to disable the nozzle check. One big drawback of this system when implemented, e.g. as in DesignJet© 750 C printers, is that if the printer is not able to fully recover the failing nozzles or there are some unstable nozzles, the system will remain in this recovery servicing mode until the decease of the printhead, being forced, by the permanent nozzle out, to run this process at the beginning of each plot. This usually leads to either an unacceptable loss of throughput and printer productivity (because the printer stops and waits for an answer, the automatic recovery process is very time consuming, and causes a big waste of ink particularly when running the priming functions) or to excessive printhead replace or continue messages that users disable nozzle check via front panel, causing throughput losses.

With reference to the present application with the term plot it is identified any kind and size of printed output of the printer, seen by the printer as a single job. The plot could then identifies a CDA image or a graphic image like a photo or any other kind of print.

In order to maintain the quality of the printed output of the printer device it is important to improve the certainty that each instruction to the printhead to produce an ink drop from a nozzle of the plurality of nozzles does will produce such an ink drop (i.e. good servicing of the printhead and replacing nozles out with working nozzles in performing error hiding).

SUMMARY OF THE INVENTION

The specific embodiments and methods according to the present invention aim to improve the servicing process without affecting the printing rate of such devices and thereby improving printing quality and the functional lifetime of the plurality of nozles.

According to an aspect of the present invention, there is provided a method of servicing a pen comprising a printhead, having a plurality of nozzles, mounted in a inkjet printing device for printing plots, comprising a servicing area and a drop detector comprising the following steps (a) performing a drop detection on the printhead to check if any of the nozzles of the printhead are malfunctioning; (b) storing the result of the more recent drop detection operation, together with the results of the previous drop detections to keep a history of the health status of each nozzle; (c) deciding whether or not to execute a recovery service in the servicing area to attempt to recover the current malfunctioning nozzles, based on the more recent status of the nozzles and on the history of the health status of the nozzles.

By executing the servicing process only when it appears as necessary helps to improve the productivity of the printer and to reduce the waste of ink and to wear the nozzle plate.

Preferably, the method comprises the steps (d) of performing an evaluation of the history of the health status of a nozzle of the printhead and (e) of marking the nozzle as a recoverable nozzle or as an irrecoverable nozzle, according to the result of the evaluation and the step (e of executing the recovery servicing if at least one recoverable nozzle, is detected as malfunctioning in the more recent drop detection.

In this way the servicing process is executed only if the malfunctioning nozzles are believed as recoverable. If all the failing nozzles are considered as irrecoverable, the process avoid to waist time and ink in running a likely useless service.

More preferably, the step (d) comprises the step of (g) keeping a score, representing the history of the health status of the nozzle, said score, determining the probability that said nozzle will not function, is increased each time that the nozzle is detected as malfunctioning or decreased when the nozzle is detected as working and wherein a recoverable nozzle is marked as an irrecoverable nozzle when the score of said nozzle reaches a first predetermined threshold.

Thus, it is provided a simple way of storing and comparing nozzle health information.

In a preferred embodiment, a step (h) of executing the recovery service is started if a number of recoverable nozzles bigger than a predetermined third threshold is detected as malfunctioning in the more recent drop detection.

This helps to avoid to run the servicing process when only few nozzles are detected as malfunctioning.

Typically, it is further comprised the steps (i) of performing a drop detection before executing a repeatable servicing procedure and, after having executed the repeatable servicing procedure on the printhead, (j) of comparing the result of the two drop detection steps in order to decide if the servicing procedure is to be repeated and the step (k) of repeating the repeatable servicing procedure if the percentage of recovered nozzles is bigger than a fourth predetermined threshold and a number of recoverable nozzles is still malfunctioning.

This helps to provide the pen with the minimum level of servicing as requested by the kind of defect of the pen and the more appropriate, in fact if the result of this specific servicing function is not good the process passes to the next level instead of repeating it.

In a further preferred embodiment the history of the health status comprises a sequence of historical values each value corresponding to the total number of malfunctioning nozzles as detected in a previous usable drop detection, and the recovery service is executed if the total number of malfunctioning nozzles is bigger than a fifth predetermined threshold, the total number of malfunctioning nozzles being selected from said sequence of historical values. In this case it is advantageously excluded the servicing in case of a non constant detection of the same high number of malfunctioning nozzles, i.e. if only a sporadic very negative drop detection occurs, no particular actions are taken to try to recover this abnormal lecture.

Preferably a usable drop detection is a drop detection performed before starting printing a plot, after having printed a plot or after having executed the recovery service. In this way it is advantageously excluded from the history all the drop detections occurred before the completion of all the servicing process, in fact those values may false the history of the nozzles adding a number of bad result and what is important to record is if the nozzles are responsive to the complete servicing strategy.

More preferably, said sequence of historical values is limited to the 8 usable drop detections more recently performed.

Viewing another aspect of the present invention, there is also provided a method of alleviating problems caused by malfunctioning nozzles of a printhead comprised in a pen mounted in an inkjet printing device, containing a drop detector, the method comprising the following steps performing a drop detection on the printhead to check the current health status of each nozzle of the printhead; based on the current status of the nozzles and on the history of the health status of the nozzles identifying the malfunctioning nozzles and deciding whether or not to start an improvement function to improve the quality of the output of the device.

Specific methods according to the present invention, recognize that by using a history of the nozzle health it is possible to improve the quality of the output in a number of different ways.

Preferably wherein the improvement function is selected from a group of functions including: a error hiding function, to attempt to minimise the usage of malfunctioning nozzles; a servicing function, to attempt to recover the malfunctioning nozzles; a printhead end-of-life function, to alert a user to replace the malfunctioning pen.

Viewing another aspect of the present invention, there is also provided inkjet printing device, for placing droplets of ink on a medium, comprising a pen comprising a printhead having a plurality of nozzles for ejecting droplets of ink, a droplet detector for identifying the nozzles of the printhead which currently present some malfunction in ejecting droplets of ink, said device being characterised by comprising a memory means for storing for each nozzle of the plurality of nozzles the history of the malfunction identified by performed droplet detections, said history being used by the device to alleviate problems caused by malfunctioning nozzles.

Preferably, the device further comprises a servicing means for recovering the defective nozzles, said history being used by the servicing means for selecting an appropriate servicing strategy.

BRIEF DESCRIPTION OF THE DRAWINGS

For a better understanding of the invention and to show how the same may be carried into effect, there will now be described by way of example only, specific embodiments, methods and processes according to the present invention with reference to the accompanying drawings in which.

DETAILED DESCRIPTION OF THE BEST MODE FOR CARRYING OUT THE INVENTION

There will now be described by way of example the best mode contemplated by the inventors for carrying out the invention. In the following description numerous specific details are set forth in order to provide a thorough understanding of the present invention. It will be apparent however, to one skilled in the art, that the present invention may be practiced without limitation to these specific details. In other instances, well known methods and structures have not been described in detail so as not to unnecessarily obscure the present invention.

Specific methods according to the present invention described herein are aimed at printer devices having a printhead comprising a plurality of nozzles, each nozzle of the plurality of nozzles being configured to spray a stream of droplets of ink. Printing to a print medium is performed by moving the printhead into mutually orthogonal directions in between print operations as described herein before. However, it will be understood by those skilled in the art that general methods disclosed and identified in the claims herein, are not limited to printer devices having a plurality of nozzles or printer devices with moving print heads.

Figure 1:
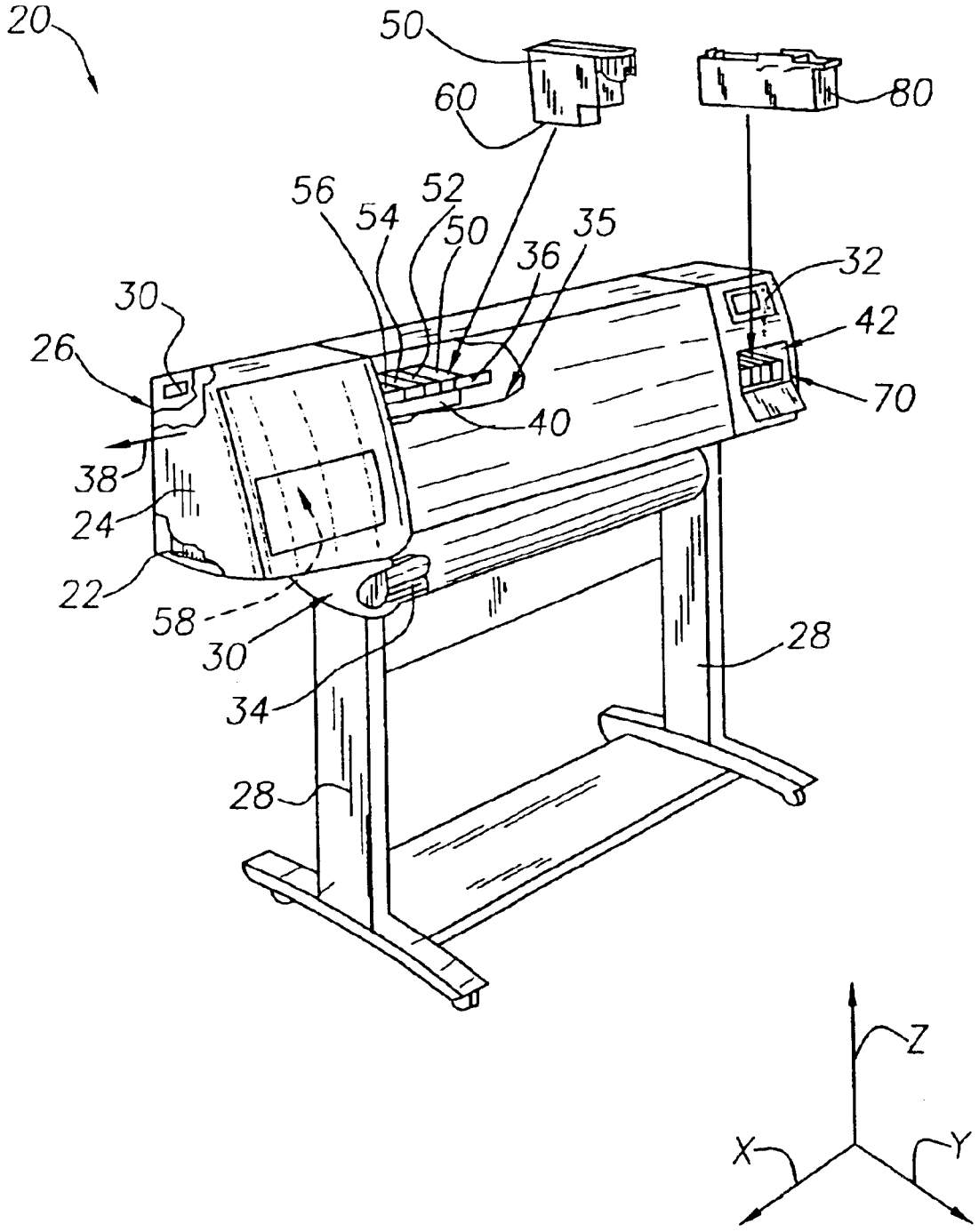
FIG. 1 is a perspective view of one form of an inkjet printing mechanism, here an inkjet printer, including one form of an inkjet printhead cleaner service station system of the present invention, shown here to service a set of inkjet printheads.

FIG. 1 illustrates a first embodiment of an inkjet printing mechanism, here shown as an inkjet printer 20, constructed in accordance with the present invention, which may be used for printing conventional engineering and architectural drawings, as well as high quality poster-sized images, and the like, in an industrial, office, home or other environment. A variety of inkjet printing mechanisms are commercially available. For instance, some of the printing mechanisms that may embody the present invention include desk top printers, portable printing units, copiers, cameras, video printers, and facsimile machines, to name a few. For convenience the concepts of the present invention are illustrated in the environment of an inkjet printer 20.

While it is apparent that the printer components may vary from model to model, the typical inkjet printer 20 includes a chassis 22 surrounded by a housing or casing enclosure 24, typically of a plastic material, together forming a print assembly portion 26 of the printer 20. While it is apparent that the print assembly portion 26 may be supported by a desk or tabletop, it is preferred to support the print assembly portion 26 with a pair of leg assemblies 28. The printer 20 also has a printer controller, illustrated schematically as a microprocessor 30, that receives instructions from a host device, typically a computer, such as a personal computer or a computer aided drafting (CAD) computer system (not shown). The printer controller 30 may also operate in response to user inputs provided through a key pad and status display portion 32, located on the exterior of the casing 24. A monitor coupled to the computer host may also be used to display visual information to an operator, such as the printer status or a particular program being run on the host computer. Personal and drafting computers, their input devices, such as a keyboard and/or a mouse device, and monitors are all well known to those skilled in the art.

A conventional print media handling system (not shown) may be used to advance a continuous sheet of print media 34 from a roll through a printzone 35. The print media may be any type of suitable sheet material, such as paper, poster board, fabric, transparencies, mylar, and the like, but for convenience, the illustrated embodiment is described using paper as the print medium. A carriage guide rod 36 is mounted to the chassis 22 to define a scanning axis 38, with the guide rod 36 slideably supporting an inkjet carriage 40 for travel back and forth, reciprocally, across the printzone 35. A conventional carriage drive motor (not shown) may be used to propel the carriage 40 in response to a control signal received from the controller 30. To provide carriage positional feedback information to controller 33, a conventional metallic encoder strip (not shown) may be extended along the length of the printzone 35 and over the servicing region 42. A conventional optical encoder reader may be mounted on the back surface of printhead carriage 40 to read positional information provided by the encoder strip, for example, as described in U.S. Pat. No. 5,276,970, also assigned to Hewlett-Packard Company, the assignee of the present invention. The manner of providing positional feedback information via the encoder strip reader, may also be accomplished in a variety of ways known to those skilled in the art. Upon completion of printing an image, the carriage 40 may be used to drag a cutting mechanism across the final trailing portion of the media to sever the image from the remainder of the roll 34. Suitable cutter mechanisms are commercially available in DesignJet® 650C and 750C color printers. Of course, sheet severing may be accomplished in a variety of other ways known to those skilled in the art. Moreover, the illustrated inkjet printing mechanism may also be used for printing images on pre-cut sheets, rather than on media supplied in a roll 34.

Figure 2:
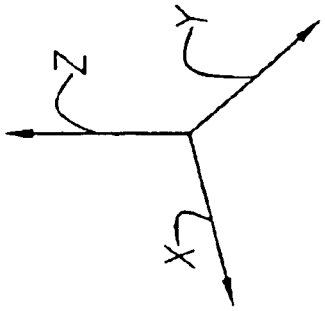
FIG. 2 is an enlarged perspective view of the service station system of FIG. 1.
Figure 2:
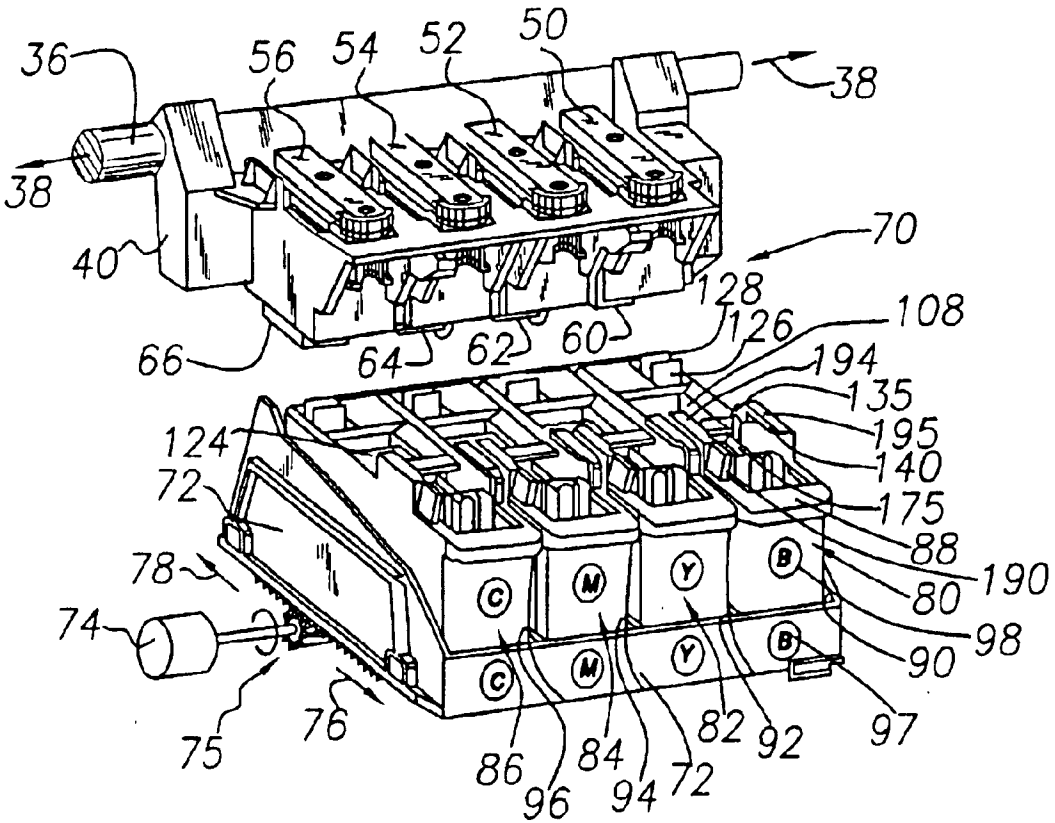

In the printzone 35, the media sheet receives ink from an inkjet cartridge, such as a black ink cartridge 50 and three monochrome color ink cartridges 52, 54 and 56, shown in greater detail in FIG. 2. The cartridges 50–56 are also often called "pens" by those in the art. The black ink pen 50 is illustrated herein as containing a pigment-based ink. For the purposes of illustration, color pens 52, 54 and 56 are described as each containing a dye-based ink of the colors yellow, magenta and cyan, respectively, although it is apparent that the color pens 52–56 may also contain pigment-based inks in some implementations. It is apparent that other types of inks may also be used in the pens 50–56, such as paraffin-based inks, as well as hybrid or composite inks having both dye and pigment characteristics. The illustrated printer 20 uses an "off-axis" ink delivery system, having main stationary reservoirs (not shown) for each ink (black, cyan, magenta, yellow) located in an ink supply region 58. In this off-axis system, the pens 50–56 may be replenished by ink conveyed through a conventional flexible tubing system (not shown) from the stationary main reservoirs, so only a small ink supply is propelled by carriage 40 across the printzone 35 which is located "off-axis" from the path of printhead travel. As used herein, the term "pen" or "cartridge" may also refer to replaceable printhead cartridges where each pen has a reservoir that carries the entire ink supply as the printhead reciprocates over the printzone.

The illustrated pens 50, 52, 54 and 56 have printheads 60, 62, 64 and 66, respectively, which selectively eject ink to from an image on a sheet of media 34 in the printzone 35. These inkjet printheads 60–66 have a large print swath, for instance about 20 to 25 millimeters (about one inch) wide or wider, although the printhead maintenance concepts described herein may also be applied to smaller inkjet printheads. The concepts disclosed herein for cleaning the printheads 60–66 apply equally to the totally replaceable inkjet cartridges, as well as to the illustrated off-axis semi-permanent or permanent printheads, although the greatest benefits of the illustrated system may be realized in an off-axis system where extended printhead life is particularly desirable.

The printheads 60, 62, 64 and 66 each have an orifice plate with a plurality of nozzles formed therethrough in a manner well known to those skilled in the art. The nozzles of each printhead 60–66 are typically formed in at least one, but typically two linear arrays along the orifice plate. Thus, the term "linear" as used herein may be interpreted as "nearly linear" or substantially linear, and may include nozzle arrangements slightly offset from one another, for example, in a zigzag arrangement. Each linear array is typically aligned in a longitudinal direction substantially perpendicular to the scanning axis 38, with the length of each array determining the maximum image swath for a single pass of the printhead. The illustrated printheads 60–66 are thermal inkjet printheads, although other types of printheads may be used, such as piezoelectric printheads. The thermal printheads 60–66 typically include a plurality of resistors which are associated with the nozzles. Upon energizing a selected resistor, a bubble of gas is formed which ejects a droplet of ink from the nozzle and onto a sheet of paper in the printzone 35 under the nozzle. The printhead resistors are selectively energized in response to firing command control signals delivered from the controller 30 to the printhead carriage 40.

FIG. 2 shows the carriage 40 positioned with the pens 50–56 ready to be serviced by a replaceable printhead cleaner service station system 70, constructed in accordance with the present invention. The service station 70 includes a translationally moveable pallet 72, which is selectively driven by motor 74 through a rack and pinion gear assembly 75 in a forward direction 76 and in a rearward direction 78 in response to a drive signal received from the controller 30. The service station 70 includes four replaceable inkjet printhead cleaner units 80, 82, 84 and 86, constructed in accordance with the present invention for servicing the respective printheads 50, 52, 54 and 56. Each of the cleaner units 80–86 include an installation and removal handle 88, which may be gripped by an operator when installing the cleaner units 80–88 in their respective chambers or stalls 90, 92, 94, and the 96 defined by the service station pallet 72. Following removal, the cleaning units 80–86 are typically disposed of and replaced with a fresh unit, so the units 80–86 may also be referred to as "disposable cleaning units," although it may be preferable to return the spent units to a recycling centre for refurbishing. To aid an operator in installing the correct cleaner unit 80–86 in the associated stall 90–96, the pallet 72 may include indicia, such as a "B" marking 97 corresponding to the black pen 50, with the black printhead cleaner unit 80 including other indicia, such as a "B" marking 98, which may be matched with marking 97 by an operator to assure proper installation.

The cleaner unit 80–86 also includes a spittoon chamber 108. For the color cleaner units 82–86 the spittoon 108 is filled with an ink absorber 124, preferably of a foam material, although a variety of other absorbing materials may also be used. The absorber 124 receives ink spit from the color printheads 62–66, and the hold this ink while the volatiles or liquid components evaporate, leaving the solid components of the ink trapped within the chambers of the foam material. The spittoon 108 of the black cleaner unit 80 is supplied as an empty chamber, which then fills with the tar-like black ink residue over the life of the cleaner unit.

The cleaner unit 80–86 includes a dual bladed wiper assembly which has two wiper blades 126 and 128, which are preferably constructed with rounded exterior wiping edges, and an angular interior wiping edge, as described in the Hewlett-Packard Company's U.S. Pat. No. 5,614,930. Preferably, each of the wiper blades 126, 128 is constructed of a flexible, resilient, non-abrasive, elastomeric material, such as nitrile rubber, or more preferably, ethylene polypropylene diene monomer (EPDM), or other comparable materials known in the art. For wipers a suitable durometer, that is, the relative hardness of the elastomer, may be selected from the range of 35–80 on the Shore A scale, or more preferably within the range of 60–80, or even more preferably at a durometer of 70 +/–5, which is a standard manufacturing tolerance.

For assembling the black cleaner unit 80, which is used to service the pigment based ink within the black pen 50, an ink solvent chamber (not shown) receives an ink solvent, which is held within a porous solvent reservoir body or block installed within the solvent chamber. Preferably, the reservoir block is made of a porous material, for instance, an open-cell thermoset plastic, such as a polyurethane foam, a sintered polyethylene, or other functionally similar materials known to those skilled in the art. The inkjet ink solvent is preferably a hygroscopic material that absorbs water out of the air, because water is a good solvent for the illustrated inks. Suitable hygroscopic solvent materials include polyethylene glycol ("PEG"), lipponic-ethylene glycol ("LEG"), diethylene glycol ("DEG"), glycerin or other materials known to those skilled in the art as having similar properties. These hygroscopic materials are liquid or gelatinous compounds that will not readily dry out during extended periods of time because they have an almost zero vapor pressure. For the purposes of illustration, the reservoir block is soaked with the preferred ink solvent, PEG.

To deliver the solvent from the reservoir, the black cleaner unit 80 includes a solvent applicator or member 135, which underlies the reservoir block.

The cleaner unit 80–86 also includes a cap retainer member 175 which can move in the Z axis direction, while also being able to tilt between the X and Y axes, which aids in sealing the printheads 60–66. The retainer 175 also has an upper surface which may define a series of channels or troughs, to act as a vent path to prevent depriming the printheads 60–66 upon sealing, for instance as described in the allowed U.S. patent application Ser. No. 08/566,221 currently assigned to the present assignee, the Hewlett-Packard Company.

The cleaner unit 80–86 also includes a snout wiper 190 for cleaning a rearwardly facing vertical wall portion of the printheads 60–66, which leads up to electrical interconnect portion of pens 50–56. The snout wiper 190 includes a base portion which is received within a snout wiper mounting groove 194 defined by the unit cover. While the snout wiper 190 may have combined rounded and angular wiping edges as described above for wiper blades 126 and 128, blunt rectangular wiping edges are preferred since there is no need for the snout wiper to extract ink from the nozzles. The unit cover also includes a solvent applicator hood 195, which shields the extreme end of the solvent applicator 135 and the a portion of the retainer member 175 when assembled.

Figure 4:
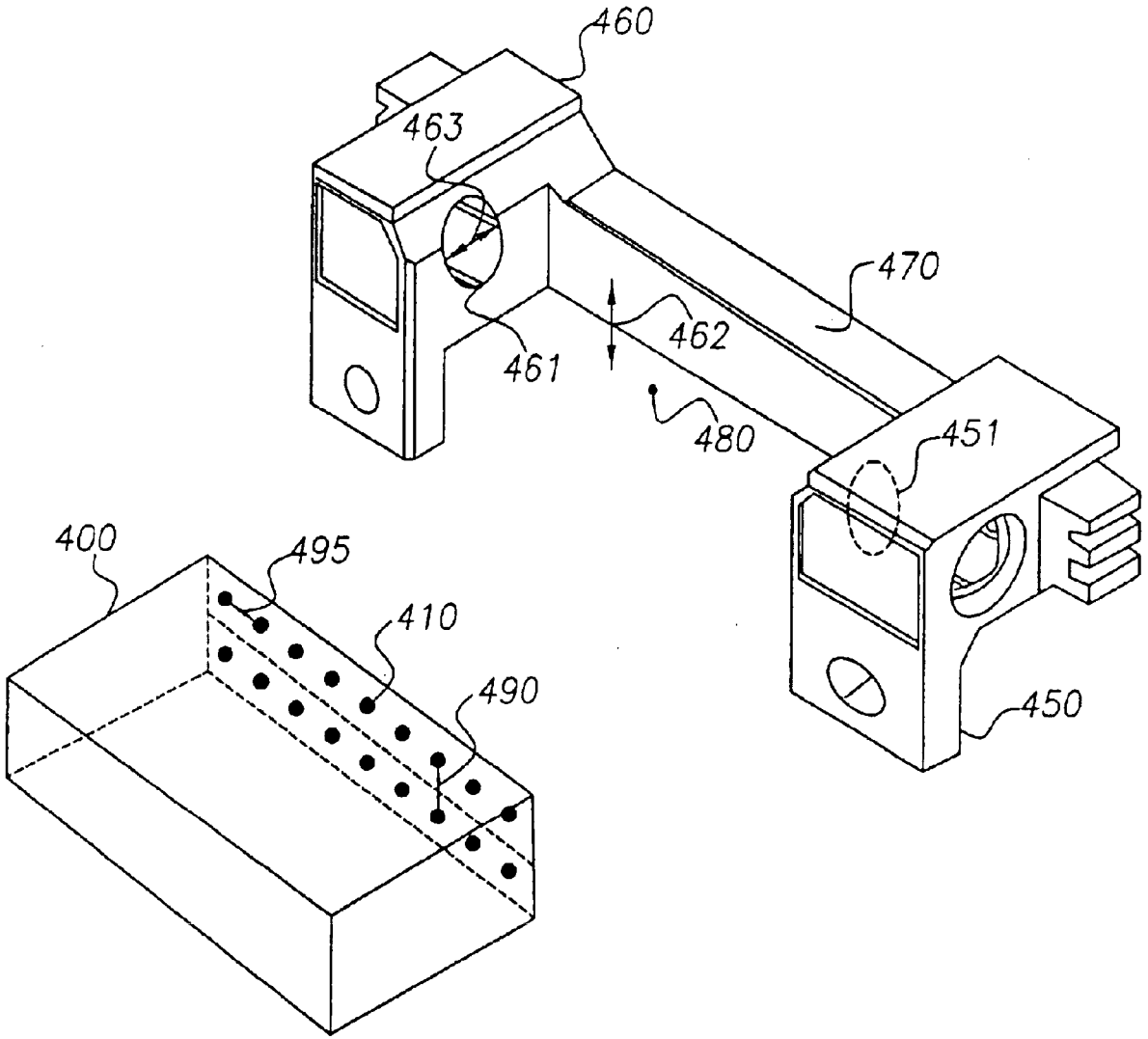
FIG. 4 illustrates an improved drop detection device according to a specific implementation of the present invention.

Referring to FIG. 4 herein, there is illustrated schematically a generic printhead and improved drop detection device according to specific embodiments of the present invention. A printhead 400, which references any of printheads 60–66, comprises an assembly of printer nozzles 410. Preferably, the printhead 400 is comprised of two rows of printer nozzles 410, each row containing 524 printer nozzles. According to a specific method of the present invention, the printer nozzles in a first row are designated by odd numbers and the printer nozzles in a second row are designated by even numbers. Preferably, a distance 490 between corresponding nozzles of the first and second rows is of the order 4 millimeters and a distance between adjacent printer nozzles 495 within a same row is 2/600 inches. There is an offset of 1/600 inches between immediately adjacent nozzles in the first and second rows of the printhead yielding a printed resolution of 600 dots per inch.

The printhead 400 is configured, upon receiving an instruction from the printer, to spray or eject a single droplet of ink 480 from single nozzle of the plurality of nozzles.

Each nozzle 410 of the plurality of nozzles comprising printhead 400 are, according to the best mode presented herein, configurable to release a sequence of ink droplets in response to an instruction from the printer device. In addition to the printhead 400, there is also included an ink droplet detection means comprising a housing 460 containing an high intensity infra-red light emitting diode; a detector housing 450 containing a photo diode detector and a elongate, substantially straight rigid member 470. The emitter housing 460, bar 470 and detector housing 450 all comprise a rigid locating means configured to actively locate the high intensity infra-red light emitting diode with respect to the photo diode detector.

The printhead 400 and the rigid locating means 460, 470 and 450 are orientated with respect to each other such that a path traced by an ink droplet 480 sprayed from a nozzle of the plurality of nozzles comprising the printhead 400 passes between emitter housing 460 and detector housing 450.

The high intensity infra-red light emitting diode contained within emitter housing 460 is encapsulated within a transparent plastics material casing. The transparent plastics material casing is configured so as to collimate the light emitted by the light emitting diode into a light beam. According to the best mode described herein, the collimated light beam emitted by the high intensity infra-red LED contained within emitter housing 460 exits the emitter housing via aperture 461. The collimated light beam from emitter housing 460 is admitted into detector housing 450 by way of aperture 451. The light beam admitted into detector housing 450 illuminates the photo diode detector contained within detector housing 450. An ink droplet 480 sprayed from a nozzle 410 entering the collimated light beam extending between apertures 461 and 451 causes a decrease in the amount of light entering aperture 451 and hence striking the photo diode contained with detector housing 450. Ink droplets are only detected if they pass through an effective detection zone in the collimated light beam which has a narrower width than a width of the collimated light beam. Preferably, the width of the effective detection zone 462 is 2 millimeters. A width 463 of the emitter housing aperture 461 and a same width of the detector housing aperture 451 are preferably 1.7 millimeters. Preferably, a main length of the collimated light beam lies transverse to and substantially perpendicular to the firing direction of the nozzles of the printhead.

Preferably, ink droplets are injected from the nozzles with an initial speed in the range of 10 to 16 meters per second. Due to effects of air resistance the initial speed of the ink droplets leaving the nozzles is progressively reduced the further each ink droplet travels from the printhead. A sequence of four ink droplets fired from a nozzle with the droplets having an initial speed of 16 meters per second and with a delay between the firing of each droplet of 83 $\mu$s, as described herein before, would occupy a total distance from the first ink droplet to the fourth ink droplet of approximately 4 mm, immediately after the fourth droplet is ejected from the nozzle. However, if the distance between the first ink droplet and the fourth ink droplet of a sequence of ink droplets fired from a nozzle is greater than the width of the effective detection zone in the collimated light beam then some droplets may remain undetected. A consequence of the progressive slowing, due to air resistance, of a sequence of ink droplets fired from a nozzle is that the distance between each droplet of the sequence of droplets decreases.

In order to maximise the probability of detecting each droplet comprising the sequence of droplets fired from a nozzle it is important that the width of the effective detection zone is greater than the corresponding distance between the first and last droplets as the droplets pass through the effective detection zone. The distance between the first and last droplets of the sequence of droplets in the effective detection zone is determined by parameters including the following:

- the initial ejection speed of ink droplets from a nozzle in the printhead; and
- the distance from a nozzle output of a printhead and the effective detection zone.

For a given initial ejection speed of droplets leaving nozzles of the printhead the closer the printhead is moved to the effective detection zone then the wider the effective detection zone must be. However, increasing the width of the effective detection zone necessitates a proportional increase in the time between firing ink droplet from adjacent nozles thereby increasing the total time required to perform drop detection according to the best mode presented herein. Conversely, if the distance between the printhead and the effective detection zone is too large then for a given width of the effective detection zone the distance between the first and last ink droplets of the sequence of ink droplets may be significantly smaller than this given width and hence there is a possibility that a droplet fired from an adjacent nozzle might mistakenly be detected concurrently with the sequence of ink droplets ejected from the nozzle currently being tested. Additionally, increasing the distance between the printhead and the effective detection zone again increases of time duration between sequences of ink droplets from adjacent nozzles of the printhead thereby increasing the total time required before drop detection. Hence it is necessary to optimize the various parameters, for example, effective detection zone width, and distance from the printhead to the effective detection zone, in order to minimize the probability of simultaneously detecting droplets ejected from neighboring nozzles of the printhead whilst also minimizing the total time required to perform drop detection. The optimization may be performed experimentally.

Figure 5:
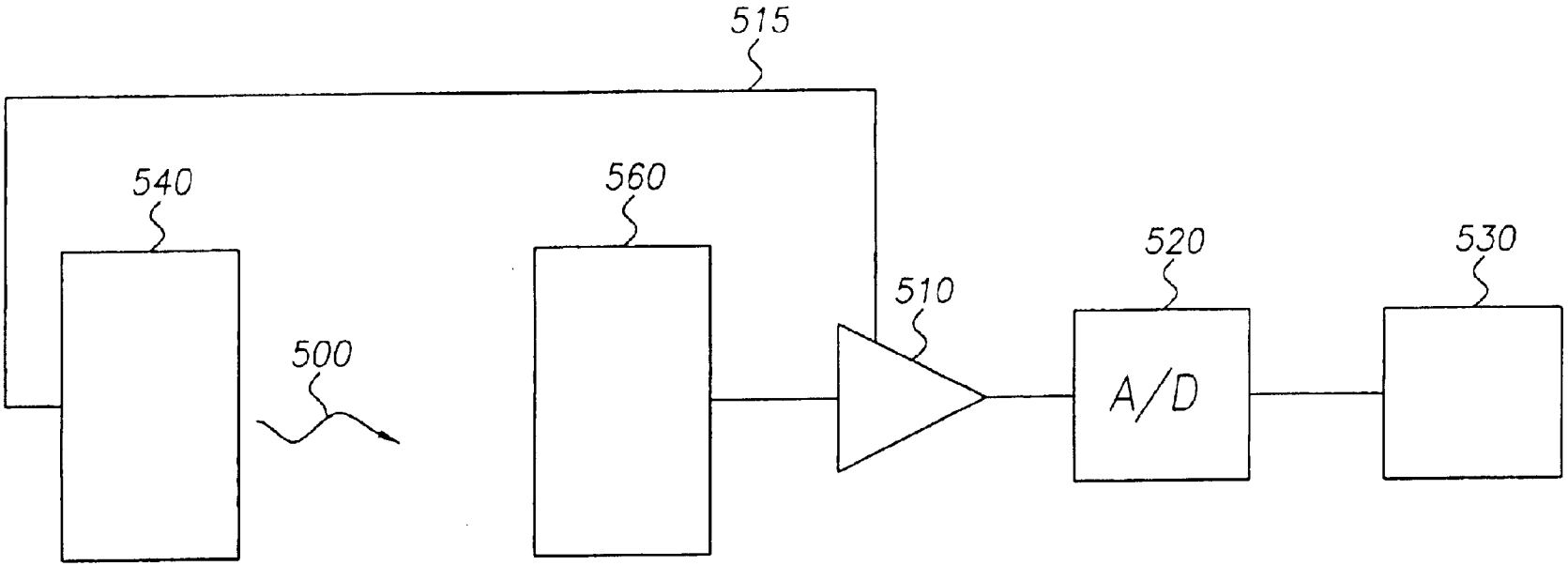
FIG. 5 illustrates schematically an overview of the functional blocks of the improved drop detection according to a specific method of the present invention.

Referring to FIG. 5 herein, there is illustrated schematically the functional blocks comprising the improved drop detection according to the best mode presented herein. High intensity infra-red LED 540 emits light 500 which is absorbed by photo diode detector 560. The output current of the photo diode detector 560 is amplified by amplifier 510. Additionally, amplifier 510 is configured to increase a driver current to high intensity infra-red LED 540 in response to a decrease in an output current of the photo diode detector 560 and to decrease an input current into high intensity infrared LED 540 in response to an increase in the output current of photo diode detector 560 via signal path 515. An amplified output current of amplifier 510 is then input into an analogue to digital (A/D) converter 520. The A/D converter 520 samples the amplified output of the photo diode. Preferably, the A/D converter 520 samples the amplified output current 64 times with a sampling frequency of 40 kilohertz. The period between samples is, preferably, 25 $\mu$s yielding a total sampling time of 1.6 milliseconds. The 64 samples of the output of the photo diode 560 are stored within a memory device in drop detection unit 530.

According to the best mode presented herein, drop detection unit 530 processes the sampled output current of the photo diode detector 560 to determine whether or not an ink droplet has crossed the collimated light beam between the high intensity infrared LED 540 and the photo diode detector 560.

Analysis of the output current of the photodiode detector 560 enables operating characteristics of the printer nozzles to be determined.

Drop detection unit 530 may also be configured to store in a memory device an indication of whether or not a nozzle of the plurality of nozzles comprising printhead 400 is "good" or "bad".

According to the best mode presented herein, before printing a page the printer device checks the nozzles comprising printhead 400 by performing a sequence of operations which are known hereinafter as drop detection. Each nozzle within a row of nozzles in turn sprays a pre-determined sequence of ink droplets such that only one nozzle is spraying ink droplets at any time. Each nozzle within the plurality of nozzles comprising the printhead are uniquely identified by a number. Preferably, a first row of nozzles are identified by a contiguous series of odd numbers between 1 and 523 and a second row of nozzles are identified by a contiguous series of even numbers between 2 and 524. During drop detection the odd numbered nozzles within a row each sprays a pre-determined sequence of ink droplets and then the printhead 400 is moved to bring the second row of nozzles in line with the effective detection zone 462. Each even numbered nozzle, in turn, sprays a same pre-determined sequence of ink droplets.

In order to maximize the signal output of the photo diode detector the pre-determined sequence of ink droplets are timed such that all of the ink droplets within the pre-determined sequence are within the collimated light beam at substantially the same moment. In order to produce a signal at the output of the photo diode detector 560 which is distinguishable from the background noise there is a minimum volume of ink which must be simultaneously occulting the collimated light beam. Preferably, the total volume of the ink droplets simultaneously located within the collimated light beam is in the range 30 to 100 pl. Hence, in a monotone pen of a printer which produces an ink droplet having a volume of 35 pl the pre-determined sequence comprises 2 ink droplets separated by a period of 83 $\mu$s. The operation of spraying a pre-determined sequence of ink droplets is also known as "spitting". The time duration of 83 $\mu$s corresponds to a spitting frequency of 12 kilohertz. The spitting frequency is also known herein as an ejection frequency. In printer devices configured to produce color prints, each ink droplet has a volume of 11 picolitres and hence the number of droplets required lie simultaneously within the collimated light beam is for yielding a total ink droplet volume in the light beam of 44 picolitres. Preferably, the spitting frequency for ink droplets in printer devices configured to produce color prints is is 12 kilohertz. It will be understood by those skilled in the art that a general method disclosed herein may be applied to printer devices having different ink droplet volumes and spitting frequencies.

Figure 6:
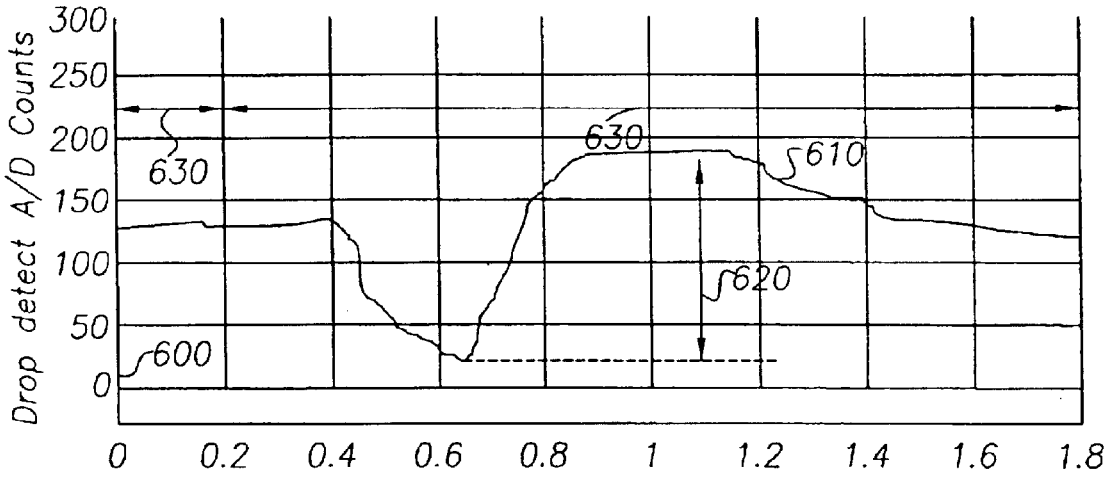
FIG. 6 illustrates, by way of example, an output signal of a drop detection device according to a specific implementation of the present invention prior to analogue to digital conversion.

Referring to FIG. 6 herein there is illustrated graphically, by way of example, an output of A/D converter 520 illustrating a signal 610 produced by a single droplet of the pre-determined sequence of ink droplets crossing the collimated light beam between the high intensity infra-red LED 540 and the photo diode 560. Referring to FIG. 6, at time 0 milliseconds (ms) a first droplet of a pre-determined sequence of droplets is sprayed from a nozzle. After a delay of 0.2 ms to allow the droplets to travel from the nozzle to the collimated light beam. The A/D converter 520 commences sampling the amplified output of the photo diode detector 560. The time delay of 0.2 ms is also known as fly time. From approximately 0.4 to 0.6 ms the output of the photo diode detector 560 drops as the pre-determined sequence of ink droplets block light entering the photo diode. At approximately 0.65 ms the sampled output of the photo diode detector 560 increases in response to an increased input current into high intensity infra-red LED 540 as a result of a decreased output current of photo diode detector 560 as described herein before. The analogue output signal of amplifier 510 is sampled periodically at a sampling frequency in the range 30 kHz to 50 kHz, and preferably at 40 kHz by the analogue to digital convertor 520. Drop detection unit 530 inputs a stream of 64 digital samples of variable amplitude representing the pulse signal 510 resulting from the passage of the ink drop past the detector. Quantization of the amplitude element of the pulse signal may be implemented in A/D convertor 520, or in drop detector 530, to produce a measure of amplitude of each sample of the 64 samples of the single pulse signal resulting from the ink drop. The peak-to-peak signal 620 corresponds to a difference between a highest number of counts sampled and a lowest number of counts sampled, where a count is a quantization unit of current or voltage of the detector output signal. Preferably, the A/D convertor 520 quantizes the current or voltage of the detector output signal into an 8-bit digital signal. Hence, according to the best mode presented herein, the current or voltage of the detector output signal may be represented by a maximum of 256 counts.

A nozzle is determined to be functioning correctly if, after spraying from the nozzle one or a plurality of ink droplets in a predetermined sequence, the peak-to-peak signal level resulting from one or a plurality of ink droplets is greater than a threshold value. It is important to choose a threshold level which lies outside the range of the natural variability of the measured peak-to-peak amplitude variation of the detector output 620 and which also lies outside the range of the variability in the noise introduced into the system by, for example, the photo diode 560 and amplifier 510.

Figure 7:
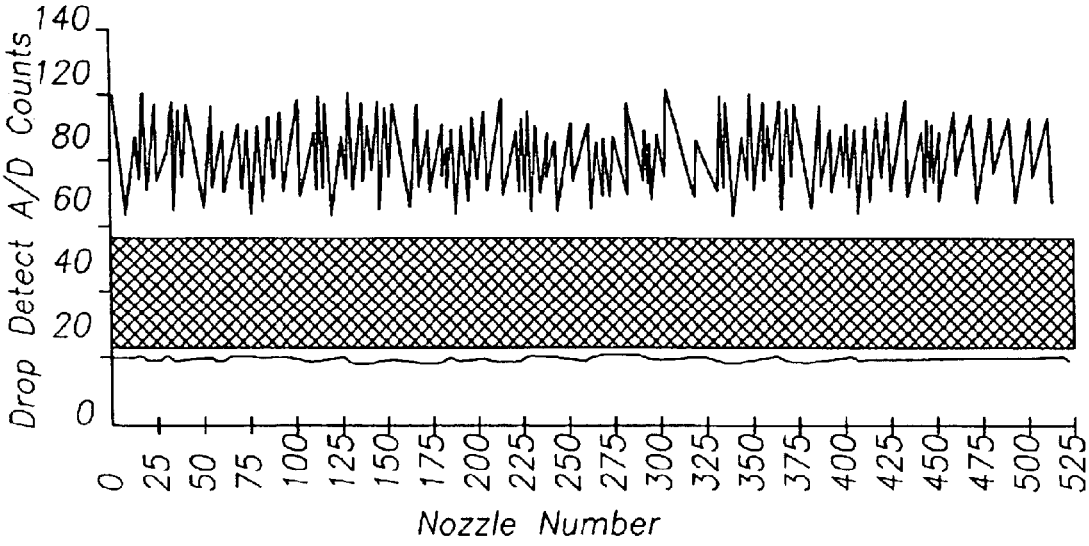
FIG. 7 illustrates graphically a region which falls within the drop detection reliability specification (hatched region); the drop detection peak to peak signal (thick line); and the noise peak to peak signal (thin line) according to a specific implementation of the present invention.

Referring to FIG. 7 herein, there is illustrated graphically typical A/D counts for peak-to-peak signals 730 for the plurality of nozzles comprising a printhead, an average noise level for noise introduced by the photo diode, etc 710 and a hatched region 720 representing the range of threshold values which could be used in the drop detection algorithm. The plotted line 730 represents for each nozzle a peak to peak amplitude of one or more signals corresponding to one or more ink droplets ejected from the nozzle. In an optimum implementation, an objective is to obtain a reliable peak to peak reading from a single signal pulse, generated by passage of a single ink droplet ejected from a nozzle, so that a reliable print head test can be obtained from just one ink droplet per nozzle being ejected. Thus, in the example nozzle characteristic of FIG. 7, ideally the plotted line 730 of the peak to peak signals for a 525 nozzle print head would be produced by 525 ink droplets (one per nozzle) and 525 corresponding pulse signals 610, each sampled into 64 quantized samples. However, the signal to noise ratio of the detected signal for a single droplet depends upon the volume of the ink droplet. The larger the ink droplet, the better the signal to noise ratio. To achieve improved reliability at the expense of speed of testing, the print head characteristic 730 may be produced by, for each nozzle, averaging the peak to peak signal of a plurality of pulses produced by a corresponding plurality of droplets ejected from the nozzle. In the best mode herein, two pulses per print nozzle are ejected in a test sequence, so for a 525 nozzle print head, the print head characteristic 730 is produced by analysing 1050 ink droplets each of volume 35 picoliters. Alternatively, reducing the droplet volume to 11 picoliters, 4 ink droplets per nozzle need to be ejected and detected to determine an average is peak to peak pulse response signal for each nozzle. Thus, for 11 picoliter droplets, for a 525 nozzle array, 2100 individual ink droplets are ejected in a test sequence, 4 per nozzle, to provide a print head characteristic 730, which is sufficiently separated from the background noise, in which the peak to peak signal for each nozzle is determined from a plurality of signal pulses produced by a plurality of ink droplets ejected from the nozzle.

Preferably, the threshold value of the peak-to-peak number of counts used to determine whether a nozzle is functioning correctly or not is 45 A/D counts. This threshold value is established by using the following constraints:

1. The probability of incorrectly detecting a good drop from the noise level is less than 0.001 parts per million. To achieve this specification the threshold level should preferably be set at least six standard deviations above the average noise level. This yields a minimum threshold level of approximately 25 A/D counts.
2. The probability of incorrectly missing a correctly functioning nozzle is less than one part per million. In order to achieve this specification the threshold level must lie below the mean peak-to-peak signal level by five standard deviations. This yields a maximum threshold level of approximately 55 A/D counts.

Hence, the choice of threshold level of 45 A/D counts lies approximately mid-way between a maximum and a minimum threshold level, where said maximum and minimum values are calculated assuming that both the noise level and peak-to-peak counts are normally distributed.

Referring to Table 1 there are summarised important parameters according to the best mode described herein.

TABLE 1

| Drop Detect Algorithm Parameter | Value |
|---|---|
| Number of drops fired per nozzle | 2 × 35 pl/4 × 11 pl |
| Spitting frequency | 12 kHz |
| Signal Sampling frequency | 40 kHz |
| Total number of samples | 64 |
| Fly time | 0.2 ms |
| Detection threshold | 45 A/D |

Figure 8:
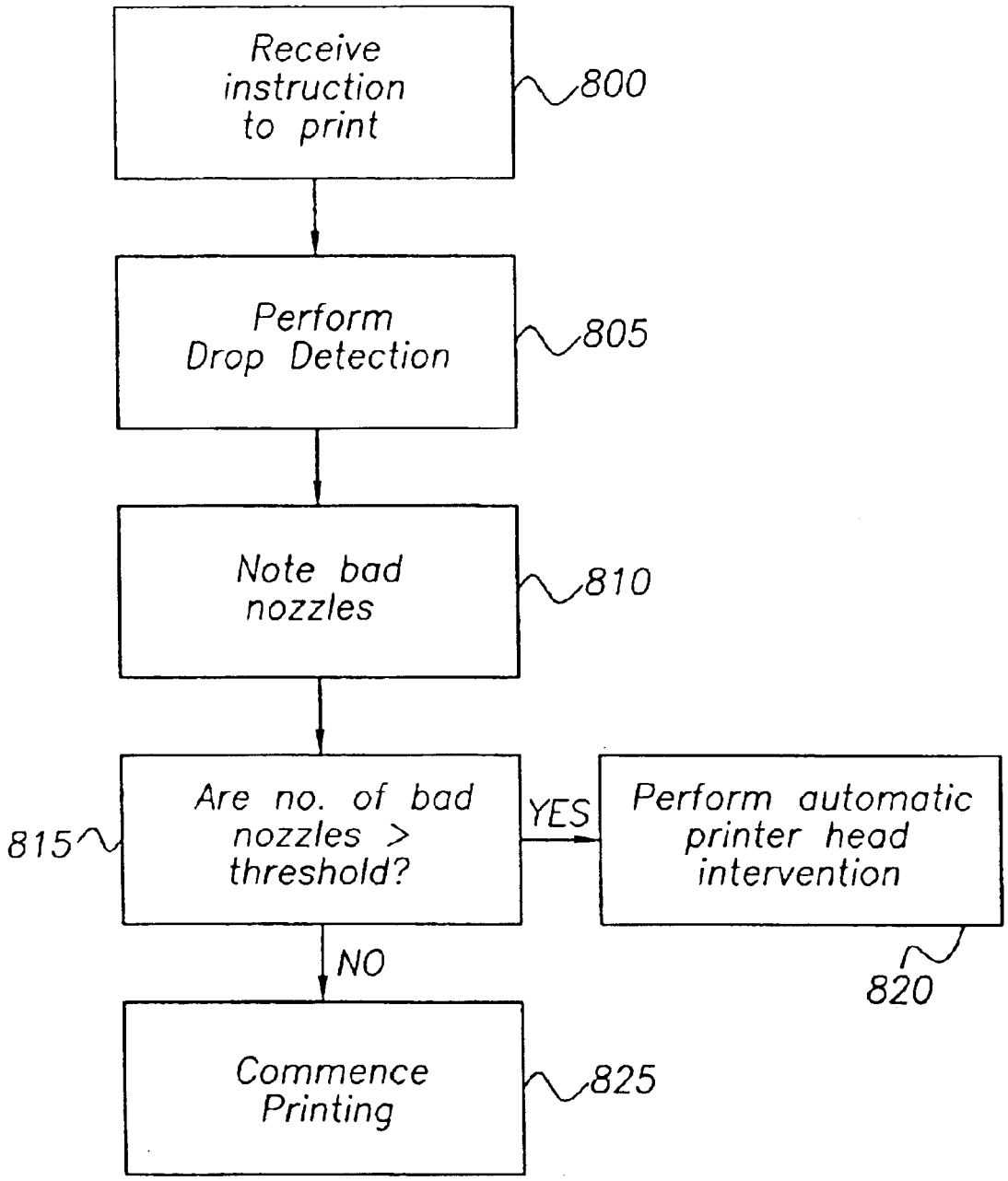
FIG. 8 illustrates schematically generalized process steps involved in drop detection performed before printing a page according to a specific method of the present invention.

Referring to FIG. 8 herein there is illustrated schematically a block diagram of the steps that occur when a printer device receives an instruction signals to print according to the best mode described herein. It will be appreciated that the print head is controlled by a series of signals generated by a print head driver device. The print head driver device comprises a processor and associated memory, operating in accordance with a set of algorithms. The algorithms may be implemented either as hardware operating in accordance with programmed instructions stored in memory locations, or as firmware in which the algorithms may be explicitly designed into a physical layout of physical components. The process steps are described herein in a manner which is independent of their particular physical implementation, and the physical implementation of such process steps will be understood by those skilled in the art. In step 800, the printer device receives an instruction to print a page. In step 805, the printer performs a drop detection procedure which comprises spraying a pre-determined sequence of ink droplets from each nozzle in turn when attempting detect the sprayed ink droplets. In step 810, the identifying numbers of nozzles which are found not to function correctly during drop detection which are also known as "bad" nozzles are stored in a memory device. In step 815, if the number of bad nozzles is greater than a threshold number then in step 820 the printer device performs an automatic printhead intervention. Performing automatic printhead intervention 820 may comprise increased cleaning of the bad nozzles in an attempt to recover them. In addition, step 820 may further comprise steps generating error hiding information by which, during a print operation, good nozzles are re-used to spray a predetermined sequence of ink droplets in the place of non-functioning nozzles thereby improving print quality. If, in step 815, the number of bad nozzles is less than a same threshold number then, in step 825, the printer device commences printing. Preferably, said step of performing automatic printhead intervention 820 is initiated if, during a last fixed number of drop detections, the number of bad nozzles was greater than the threshold level. Preferably, the fixed number of previous drop detections may be 8, 16 or 64.

Figure 9:
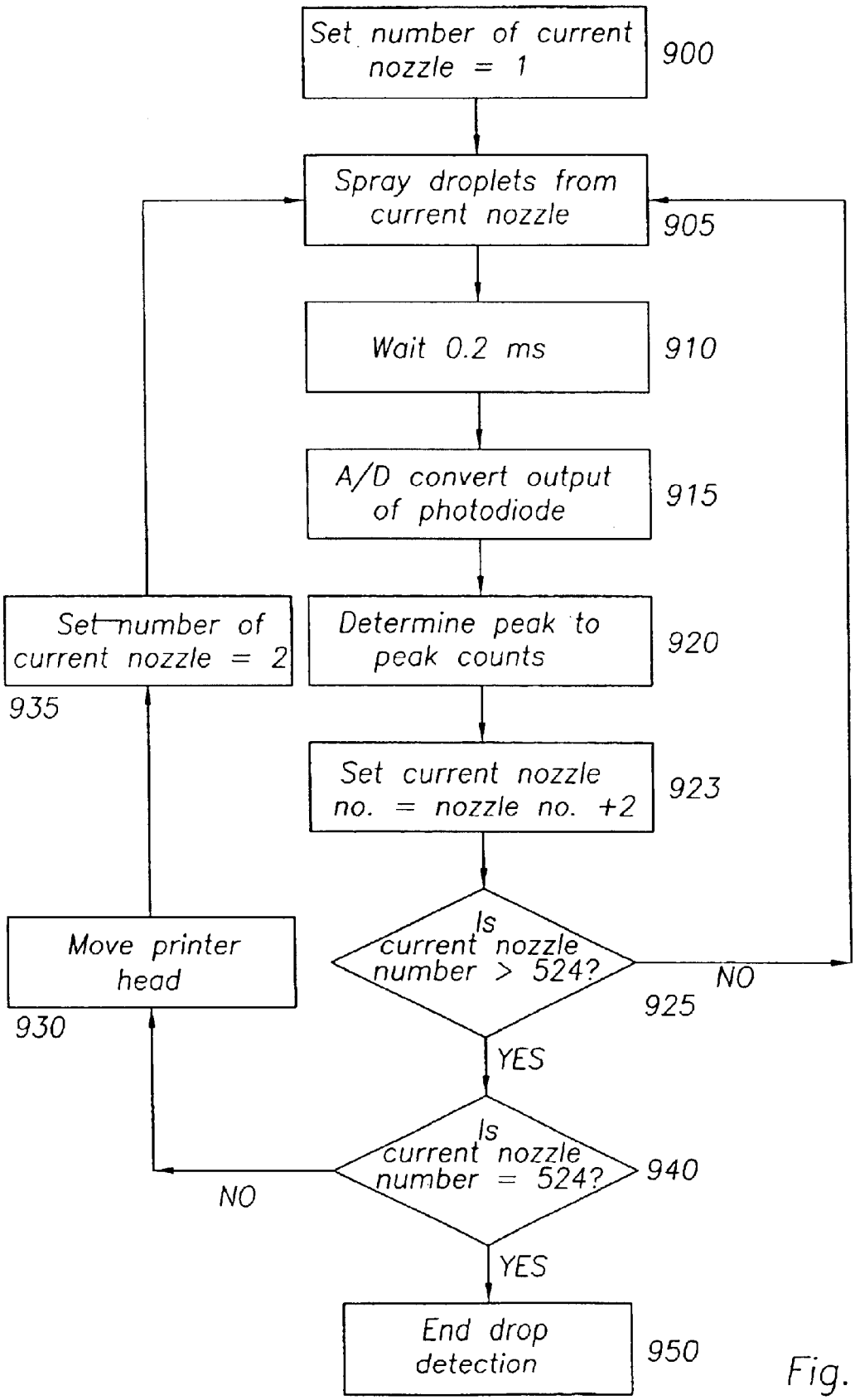
FIG. 9 illustrates schematically in more detail steps involved in drop detection according to a specific method of the present invention.

Referring to FIG. 9 herein, there is illustrated schematically a block diagram of the steps comprising drop detection step 805. In step 900, a number identifying a current nozzle of the plurality of nozzles of the printhead to be tested using drop detection is set to equal 1. In step 905 the current nozzle is instructed to spray a pre-determined sequence of droplets. Preferably, as described herein before, for a printer configurable to produce monotone output the pre-determined sequence comprises two droplets separated in time by a period of 83 $\mu$s. Preferably, where the printer device is configurable to produce color output the pre-determined sequence comprises four droplets spaced apart by a same duration of time of 83 $\mu$s. In step 910, there is a delay of 0.2 milliseconds which commences from substantially the same moment of time that a first droplet of the pre-determined sequence of droplets leaves the current nozzle. This delay enables the droplets to enter the infra-red light beam extending between emitter housing 460 and receiver housing 450 before measuring the output of the photo diode detector 560. This delay time is also known as "fly" time. In step 915 the A/D converter 520 measures an amplified output of photo diode detector 560. Preferably, the A/D converter 520 samples the amplified output of the photo diode detector 560 64 times with a same time duration of 25 $\mu$s between each measurement. This corresponds to a signal sampling frequency of 40 kilohertz. In step 920, the samples are processed using an algorithm to determine the peak-to-peak counts, which are used to discriminate between detection and non-detection of ink droplets sprayed from the current nozzle. Each nozzle receives a drive signal causing the nozzle to release a number of ink droplets corresponding to a predetermined volume of ink, preferably in the range 30 to 100 picoliters. The volume of ink is selected such that either a single ink droplet of at least the predetermined volume produces a detector signal having sufficient signal to noise ratio to reliably determine detection of the drop, and/or such that a series of two or more droplets having a combined volume which is at least the predetermined volume result in a series of detected signal pulses which when analyzed together, have a signal to noise ratio sufficient to reliably determine satisfactory operation of the nozzle. It has been found experimentally as described hereinabove in this specification, that in the best mode a predetermined volume of around 70 picoliters divided into two consecutively released droplets is optimum for characterizing a nozzle releasing black ink, and a predetermined volume of around 44 picoliters contained as 4 consecutively released droplets is optimum for characterizing a nozzle releasing coloured ink, of a colour other than black. In step 923, the number identifying the current nozzle is incremented by 2. By this means, the nozzle number 1, 3, 5, . . . , 523 comprising the first row are tested for correct functionality according to the best mode presented herein. In step 925, if the number identifying the current nozzle is less than 524 then steps 905 to 925 are repeated for the next nozzle. In step 940, if the number identifying the current nozzle is 524 then the perform drop detection step 805 is completed. Otherwise, in step 930, the printhead 400 is moved so as to ensure that droplets sprayed from the second row of even numbered nozzles passes through the effective detection zone of the infra-red light beam. In step 935, the number identifying the current nozzle is set equal to 2 and steps 905 to 925 are repeated for the even numbered nozzles comprising the second row of the printhead.

Figure 10:
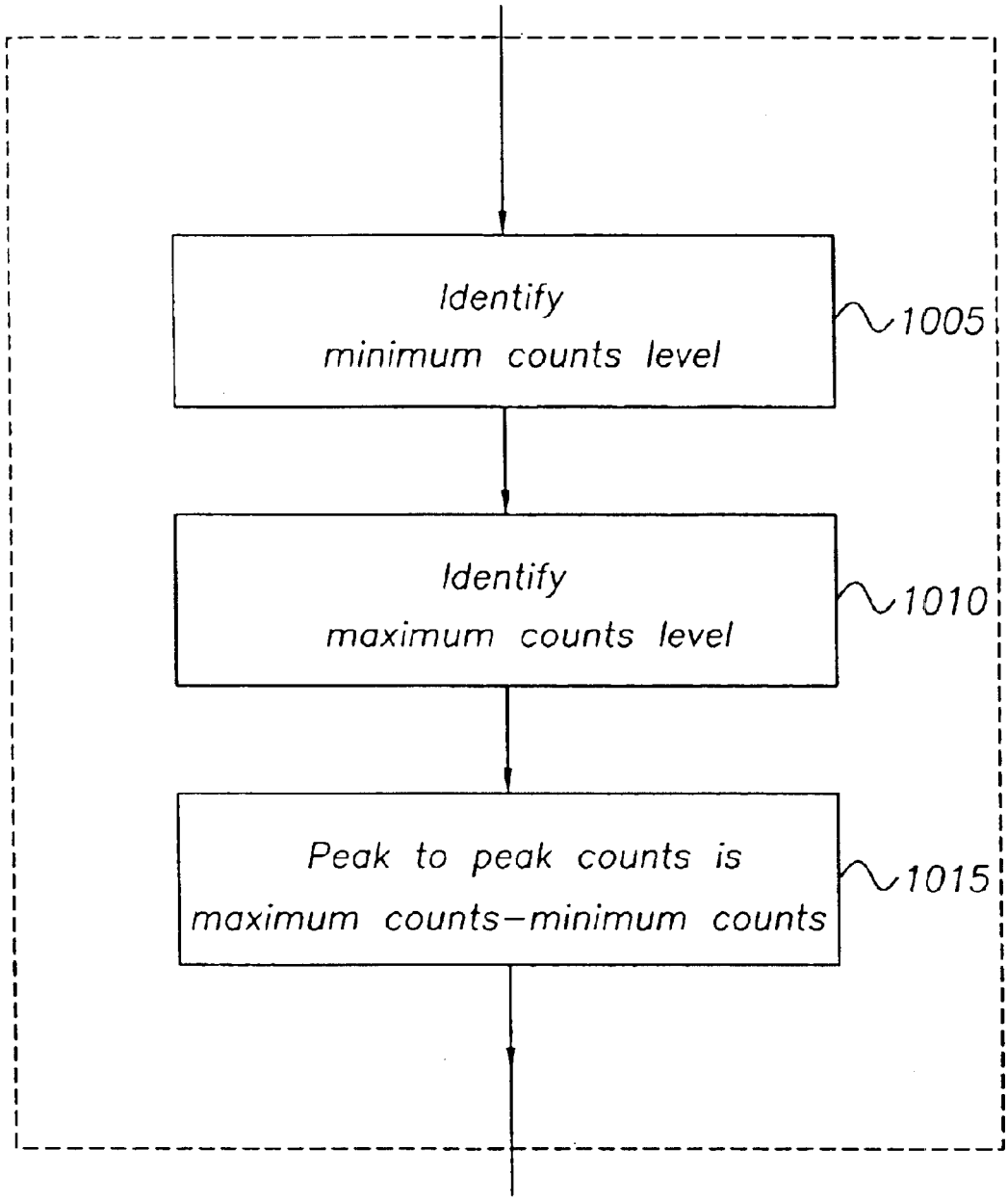
FIG. 10 illustrates schematically in more detail further steps involved in drop detection according to a specific method of the present invention.

Referring to FIG. 10 herein, there is illustrated schematically a flow diagram showing in more detail the steps involved in step 920 of FIG. 9. In step 1005, a minimum count level sampled by the A/D converter 520 sampling the output of photo diode 560 is identified. In step 1010, a maximum count level corresponding to the peak output from the photo diode detector 560 is identified. In step 1015, the peak-to-peak counts are calculated by forming a difference between the maximum count level and the minimum count level. In the best mode herein, this processing is performed by an Application Specific Integrated Circuit (ASIC) operating instructions stored in a read only memory.

Referring to Table 2 herein there are summarised the minimum detection times required to check the 524 nozzles comprising a printhead. The total time required to check pen comprising 524 nozzles within a printer device configured to print monotone plots is of the order 2 seconds. Approximately 1 second is required to move the nozzles into position with respect to the drop detect unit and a further period of approximately 1 second is required to perform drop detection on the 524 nozzles. Similarly, the time required for the improved drop detection method and apparatus to test the 2096 nozzles corresponding to 4 pens within a printer device configured to produce color plots is of the order 5 seconds. This represents a significant improvement over prior art drop detection methods where, typically, 25 seconds was required to assess 600 nozzles.

TABLE 2

| Drop Detect Throughput | Seconds |
|---|---|
| Monotone Plots (1 pen) | 2 |
| Color Plots (4 pens) | 5 |

Reducing the time required to test the individual nozzles of a plurality of nozzles comprising a printhead and reduces the total time required to test a printhead. A decrease in the time required to test a printhead also corresponds to an increase in drop detect throughput. Increased drop detect throughput results in the following improvements:

- It is possible to perform an increased number of tests of each nozzle of the plurality of nozzles without substantially effecting the total time required to print a page;
- Increasing the number of tests on each nozzle improves reliability of the printhead since this yields a more up to date knowledge of the state of the printheads;
- More accurate knowledge of the malfunctioning nozzles improves the operation of error hiding print modes performed by the printer device. Error hiding print modes operate by deactivating a malfunctioning nozzle and reusing a functioning nozzle to print in its place during a print operation; and Increased tests on the functioning of nozzles enables more accurate functioning of a set of servicing algorithms via the printer device. The servicing algorithms are sets of instructions performed before printing a page, during printing and after a page has been printed and are designed to maintain correct operation of the nozzles comprising the printhead. Improved servicing of the nozzles results in an increased operating lifetime of the printhead.

In the following, with reference to FIG. 11, it will be described how a more accurate servicing or clearing process may be implemented, for example in the inkjet printer 20.

This process allows to adjusts servicing based on the nozzle health information gathered during the last eight usable drop detections, and not only in the most recent one (also identified as "current drop detection"), and allowing to show how persistent or irrecoverable the failures of the nozzles are. It would be clear to the skilled in the art that information referring to more than the last eight drop detections may be stored, up to the all the drop detections performed during the complete life of the printhead, in order to improve the reliability of this process.

The following definitions will be used to describe the process in greater detail:

D (Historical Drop Detection Array): It Contains the Total Number of Defective Nozzles Found in the Last Usable Eight Drop Detection's, in Chronological Order D[7] is the total nozzle defects detected during the last drop-detection D[0] is the total nozzle defects detected eight usable drop detects ago.

Dsort (Sorted Historical Drop Detection): It Contains the Same Information as D but in Increasing Order from Minimum Number of Nozzles out Found —Dsort[0]— to the Maximum—sort[7]—.

DDnth (nth Percentile of D): It points to a value contained in Dsort[n]. This is obtained using reading the Dp value in Dsort. In this embodiment, the percentile used is 50%, which is obtained by using a Dp=3. Thus, DDnth contains the result of the median drop detection, excluding the higher failure values which are contained in Dsort[4) to Dsort[7].

Dp (pointer index): it identifies the DDnth percentile in the Dsort vector. Zero means the first one, 7 means the last one. As already said in this embodiment this value is 3

DDMap (Array of the Result of Last Drop Detection): this array shows the status for each nozzle. A working nozzle is a zero, a malfunctioning nozzle is a one.

For the sake of clarity, a plurality of DDMap arrays are maintained in memory each one containing the health information for each of the nozzles during a different usable drop detection (e.g. as shown in next Table 3) even though in the following when the description refers to DDMap it will be the DDMap referring to the most recent drop detection.

$Perm_{Map}$ (Array of the Nozzles that have a Higher Probability of Failing During the Next Plot after the Last Drop Detection): this array contains, a value of zero for a working nozzle, and a value of one for a nozzle being detected as permanent defective.

$Perm_{Score}$ (Array of the Counters Used to Track Persistency of Nozzle Health Issues after the Last Drop Detection): this arrays contains the score assigned to each nozzle according to the following rules:

WoundNozzleScore: amount by which the $Perm_{Score}$[j] is incremented every time nozzle[j] check fails at beginning of plot or at end of plot. In this embodiment this value is 0.

DeadNozzleScore: amount by which the $Perm_{Score}$[j] is incremented every time nozzle[j] check fails after performing a recovery servicing. In this embodiment this value is +9.

LivingNozzleScore: amount by which the $Perm_{Score}$[j] is reduced every time nozzle[j] check is OK. In this embodiment this value is 20.

NozzleKillScore: when $Perm_{Score}$[j] reaches this level, the process considers nozzle[j] to suffer a permanent defect and set $Perm_{Map}$[j] to 1. In this embodiment this level is 50. $Perm_{Score}$[j] will not go higher and will stay at NozzleKillScore level if nozzle [j] checks continue to fail.

NozzleResurectScore: when $Perm_{Score}$[j] reaches this level, the process considers nozzle [j] as being recovered from permanent defect and set $Perm_{Map}$[j] to 0. This embodiment this level is zero. According to this scheme, a nozzle is normally removed from the $Perm_{Map}$ array after being detected as working during 3 subsequent drop detection. This allows to maintain for a longer period flagged as out also an intermittent nozzle. $Perm_{Score}$[j] will not go lower and will stay at NozzleResurectScore level if nozzle [j] checks continue to be OK.

In order to clarify the usage of the above parameters in the following it is provided an example with a pen having a printhead with only eight nozzles.

At the initial drop detection $Perm_{Map}$ has the following values{1 0 0 0 0 0 0 1} while the $Perm_{Score}$ array has {30 0 0 0 42 15 5 50}. This means that nozzles 1, and 8 are identified as suffering of a permanent defect.

The next tables 3, 4, 5 show the history of the last eight usable drop detects from the older drop detection 0 to the more recent one 7. In the tables drop detections 7, 4 and 1 correspond to drop detections performed at the end of printing a plot (EOP); 6, 3, and 0 correspond to drop detections performed before to starting to print a plot (BOP), while 5 and 2 correspond to drop detections performed after performing a recovery servicing (INT).

TABLE 3

| | EOP | BOP | INT | EOP | BOP | INT | EOP | BOP |
|---|---|---|---|---|---|---|---|---|
| | $DD_{Map}$[i] | | | | | | | |
| Nozzle | 0 | 1 | 2 | 3 | 4 | 5 | 6 | 7 |
| 1 | 1 | 0 | 0 | 0 | 0 | 1 | 0 | 0 |
| 2 | 0 | 0 | 0 | 0 | 0 | 0 | 0 | 0 |
| 3 | 0 | 0 | 0 | 0 | 0 | 0 | 0 | 0 |
| 4 | 0 | 0 | 0 | 0 | 0 | 0 | 0 | 0 |
| 5 | 1 | 1 | 1 | 1 | 1 | 0 | 0 | 1 |
| 6 | 0 | 1 | 0 | 0 | 1 | 0 | 0 | 0 |
| 7 | 0 | 0 | 0 | 0 | 0 | 0 | 0 | 0 |
| 8 | 1 | 1 | 1 | 0 | 0 | 0 | 0 | 0 |
| D | 3 | 3 | 2 | 1 | 2 | 1 | 0 | 1 |
| $D_{sort}$ | 1 | 1 | 1 | 1 | 2 | 2 | 3 | 3 |
| Dp | | | | | | | | 3 |
| $DD_{50\%}$ | | | | | | | | 1 |

TABLE 4

| | $Perm_{Score}[j]$ | | | | | | | |
|---|---|---|---|---|---|---|---|---|
| Nozzle | 0 | 1 | 2 | 3 | 4 | 5 | 6 | 7 |
| 1 | 32 | 12 | 0 | 0 | 0 | 9 | 0 | 0 |
| 2 | 0 | 0 | 0 | 0 | 0 | 0 | 0 | 0 |
| 3 | 0 | 0 | 0 | 0 | 0 | 0 | 0 | 0 |
| 4 | 0 | 0 | 0 | 0 | 0 | 0 | 0 | 0 |
| 5 | 44 | 44 | 50 | 50 | 50 | 30 | 10 | 10 |
| 6 | 0 | 0 | 0 | 0 | 0 | 0 | 0 | 0 |
| 7 | 0 | 0 | 0 | 0 | 0 | 0 | 0 | 0 |
| 8 | 50 | 50 | 50 | 30 | 10 | 0 | 0 | 0 |

TABLE 5

| | $Perm_{Map}[j]$ | | | | | | | |
|---|---|---|---|---|---|---|---|---|
| Nozzle | 0 | 1 | 2 | 3 | 4 | 5 | 6 | 7 |
| 1 | 1 | 1 | 0 | 0 | 0 | 0 | 0 | 0 |
| 2 | 0 | 0 | 0 | 0 | 0 | 0 | 0 | 0 |
| 3 | 0 | 0 | 0 | 0 | 0 | 0 | 0 | 0 |
| 4 | 0 | 0 | 0 | 0 | 0 | 0 | 0 | 0 |
| 5 | 0 | 0 | 1 | 1 | 1 | 1 | 1 | 1 |
| 6 | 0 | 0 | 0 | 0 | 0 | 0 | 0 | 0 |
| 7 | 0 | 0 | 0 | 0 | 0 | 0 | 0 | 0 |
| 8 | 1 | 1 | 1 | 1 | 1 | 0 | 0 | 0 |

At the end of the eight usable drop detections the values are:

$Perm_{Map}=\{0\ 0\ 0\ 0\ 1\ 0\ 0\ 0\}$, $Perm_{Score}=\{0\ 0\ 0\ 0\ 12\ 0\ 0\ 0\}$ and $DD_{50\%}=1$. At this time only nozzle 5 is considered permanently defective.

Figure 11:
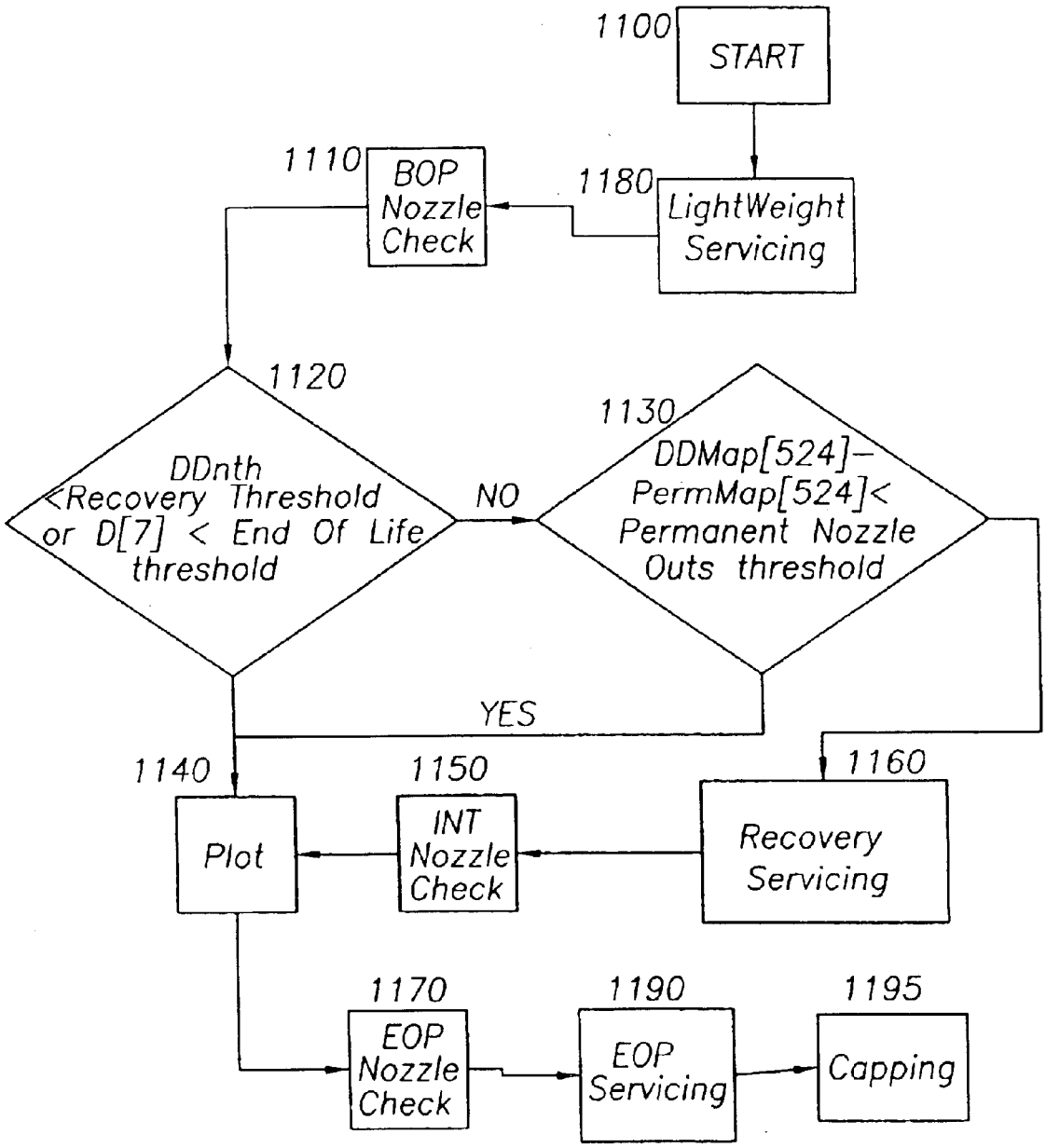
FIG. 11 illustrates schematically steps involved in printhead service according to a specific method of the present invention.

With reference to FIG. 11, the servicing process as implemented in one embodiment of the present invention will be described limited to the servicing of one pen for the sake of simplicity. The skilled in the art may appreciate that the same process can be performed, without substantial modifications, on the full set of pens, by performing some steps in parallel on the different pens (e.g. servicing) and some in sequence (e.g. drop detection) or even all in parallel or in sequence.

The process start at step 1100 when the signal to start printing a plot is sent to the printer 20. At this stage a lightweight servicing step 1180 is executed. A lightweight servicing may include conventionally spitting a predetermined number of droplets into the spittoon 108. According to the time the pen rested in the service station capped, an higher predetermined number of droplets may be spitted and a conventional wiping step can be also added. At step 1110 a drop detection process is performed, as described previously described, on the printhead 400. At test 1120 it is verified if the number of nozzles out of the nth percentile, in this embodiment 50, of the drop detection history is below a predetermined Recovery threshold value, here 2 if the printhead pertains to the black pen or 6 if the printhead pertains to the for color pens, or the last drop detection has revealed a current number of nozzles out is smaller than a predetermined End of Life threshold value, here equal to 5 for black pens and equal to 8 for color pens. If the result of test 1140 is YES the process pass to step 1140, wherein the printer prints the plot. If the result is NO, the control passes to test 1130. In 1130 the nozzles which are present in the DDMap and not in the PermMap are counted and summed together. Then if this sum is smaller than a predetermined Permanent Nozzles Out threshold value the control pass again to step 1140. Step 1130 try to avoid servicing on nozzles that probably will not be recovered by the recovery servicing. In fact if all the nozzles detected as out in the last drop detection were already in the PermMap running a recovery service would probably just reduce the throughput of the printing, or damage other working nozzles and loose some ink.

If the result of test 1130 is NOT, the recovery service procedure is started to try to recover all the nozzles out. This procedure will be described in greater details with reference to FIGS. 12–14.

After the completion of the recovery procedure another Drop detection is performed in order to check the result of the servicing. The value of this drop detect is stored as part of the history of the printhead, as shown before and no further servicing activity are now performed. Then step 1140 is executed. When the plot is completed a new drop detection is performed on the printhead at step 1170. Immediately after, at step 1190, an end of plot servicing is performed on the pen. An end of plot servicing may include conventionally spitting a predetermined number of droplets into the spittoon 108. According to the results of the last drop detection, an higher predetermined number of droplets may be spitted and a conventional wiping step can be also added. After the servicing the pen is capped at step 1195 in the service station until a request for printing a new plot is sent to the printer, then the process starts again from step 1100.

Figure 12:
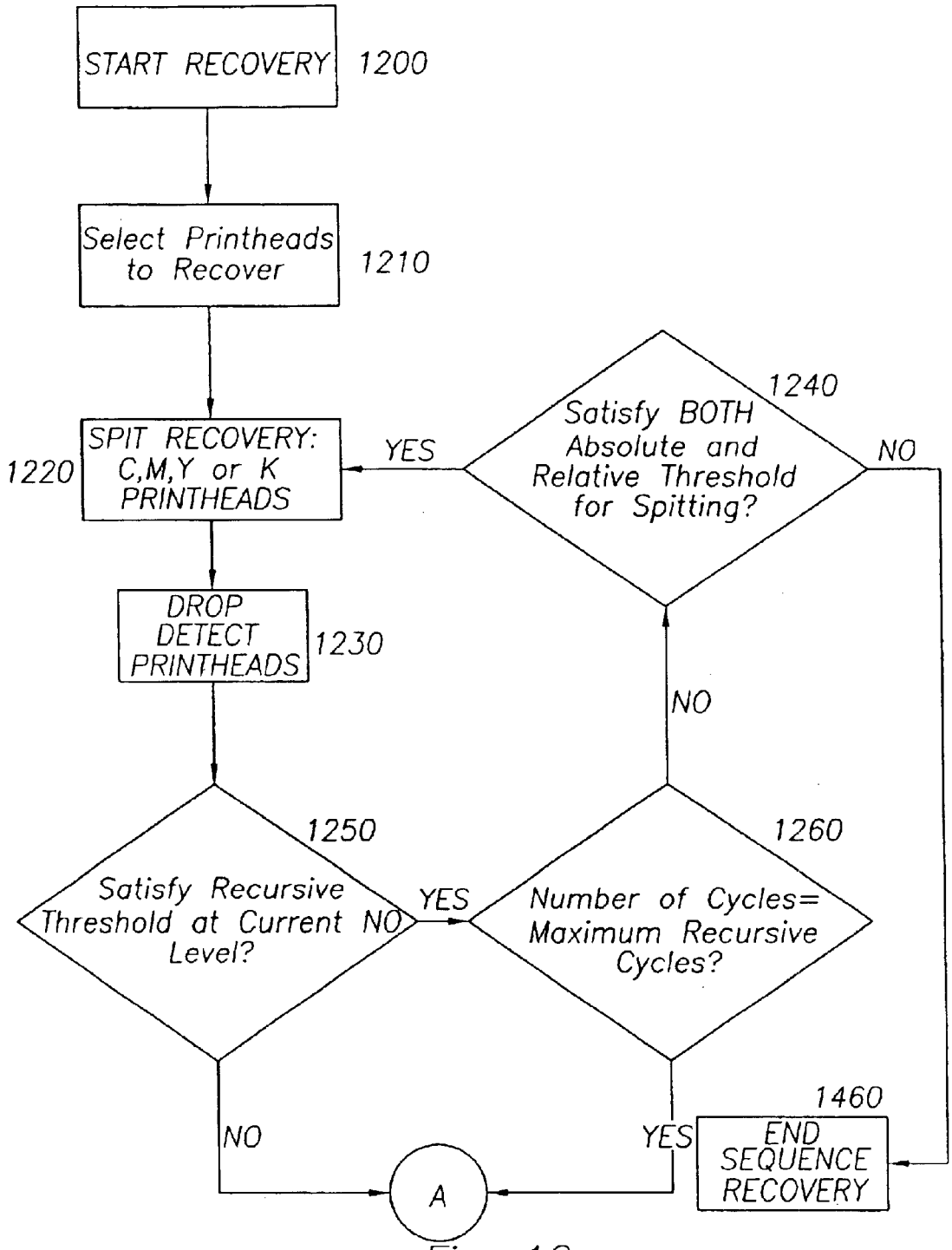
FIGS. 12–14 illustrate in more detail steps involved in printhead service according to a specific method of the present invention.
Figure 13:
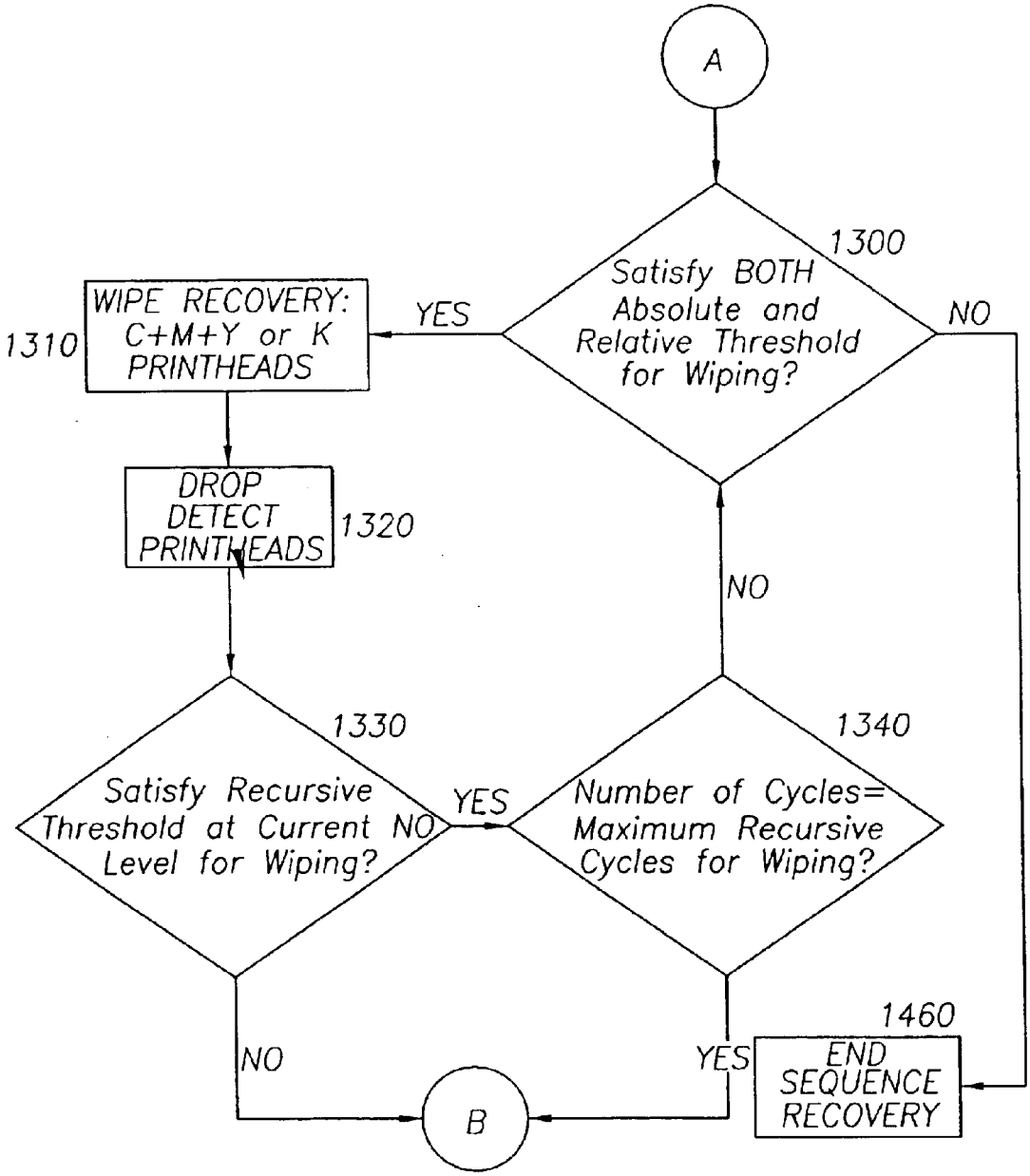
Figure 14:
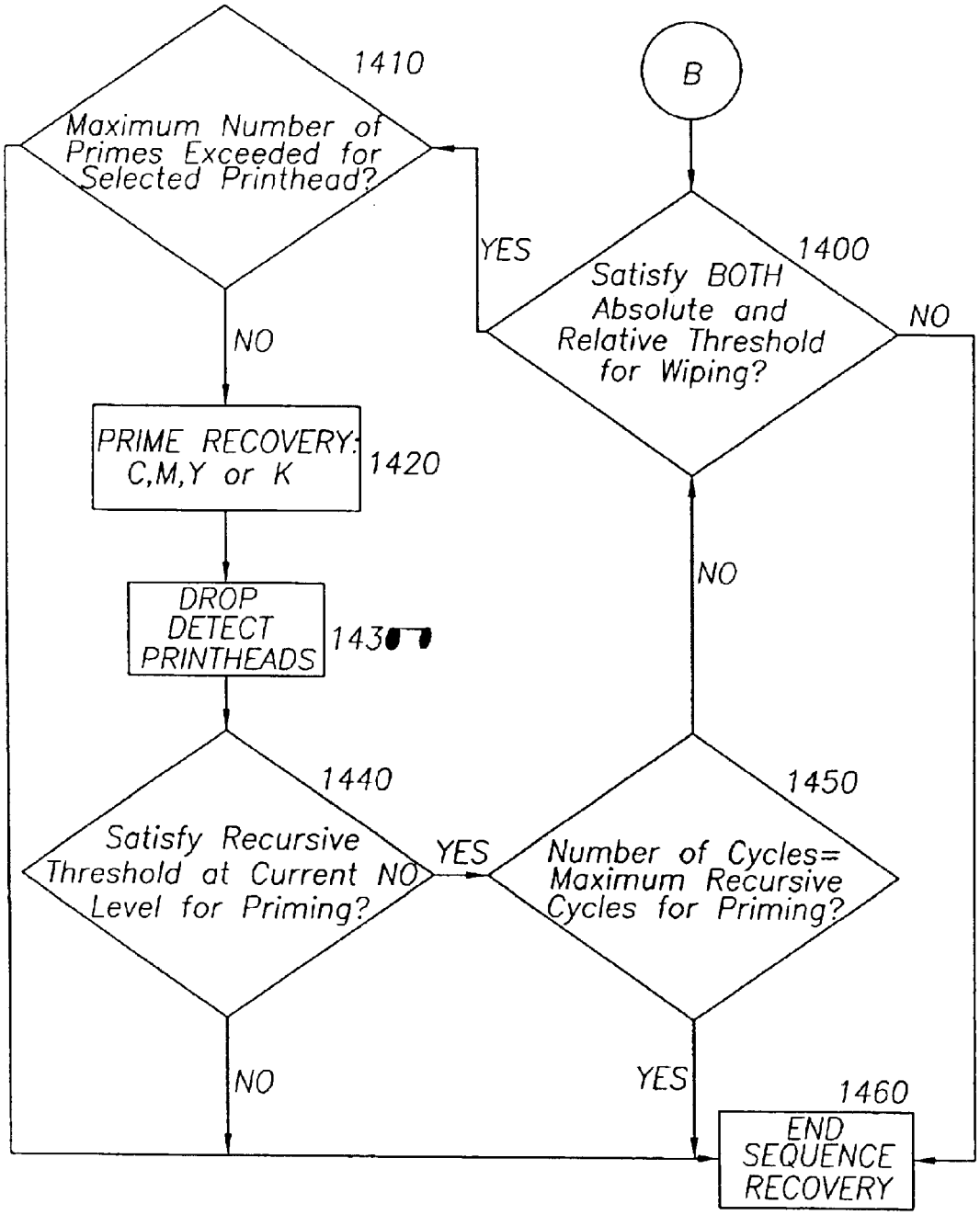

With reference to FIGS. 12–14, an example of the recovery servicing procedure 1160 is provided.

According to this example further threshold values have been defined, all the predetermined values assigned to the various threshold are specific to this embodiment and may vary in accordance to different servicing requirements of different embodiments.

Absolute Threshold for Spitting, Absolute Threshold for Wiping and Absolute Threshold for Priming relate to absolute number of nozzles out in the last drop detection for each respective printhead, i.e. DDMap[j] contents for each printheads. These thresholds are related to the level at which the printhead would start demonstrating print quality defects. The level is adjusted so that a noisy low level nozzles out will not force an excessively high intervention frequency. The value of the Absolute Threshold for Spitting and the Absolute Threshold for Wiping is set to 1 for all the printheads, while the value of the Absolute Threshold for Priming is set to 4 for the color printheads (CMY) and to 2 for the black printhead.

Relative Threshold for Spitting, Relative Threshold for Wiping and Relative Threshold for Priming compare the current nozzles out, DDMap[j], to the nozzles which exist in the map of permanent nozzles, PermMap[j], and determines if the current nozzle out snapshot varies enough from the permanent nozzles to warrant a recovery. This threshold is designed to ensure that permanent nozzles are not triggering unnecessary recovery routines when the likelihood that a recovery will not have any effect on the permanent nozzles out is very high. The values for all the relative thresholds and for all the printheads is set to 2.

Recursive Threshold for Spitting and Recursive Threshold for Priming allow determination of the recovery effectiveness of the previous recovery pass, and it is used to indicate if an additional pass through the same recovery pass is likely to recover another significant number of nozzles out. If the recovery efficacy falls below the threshold, it is determined that another similar step would not have a beneficial effect on the printhead state.

Figure 15:
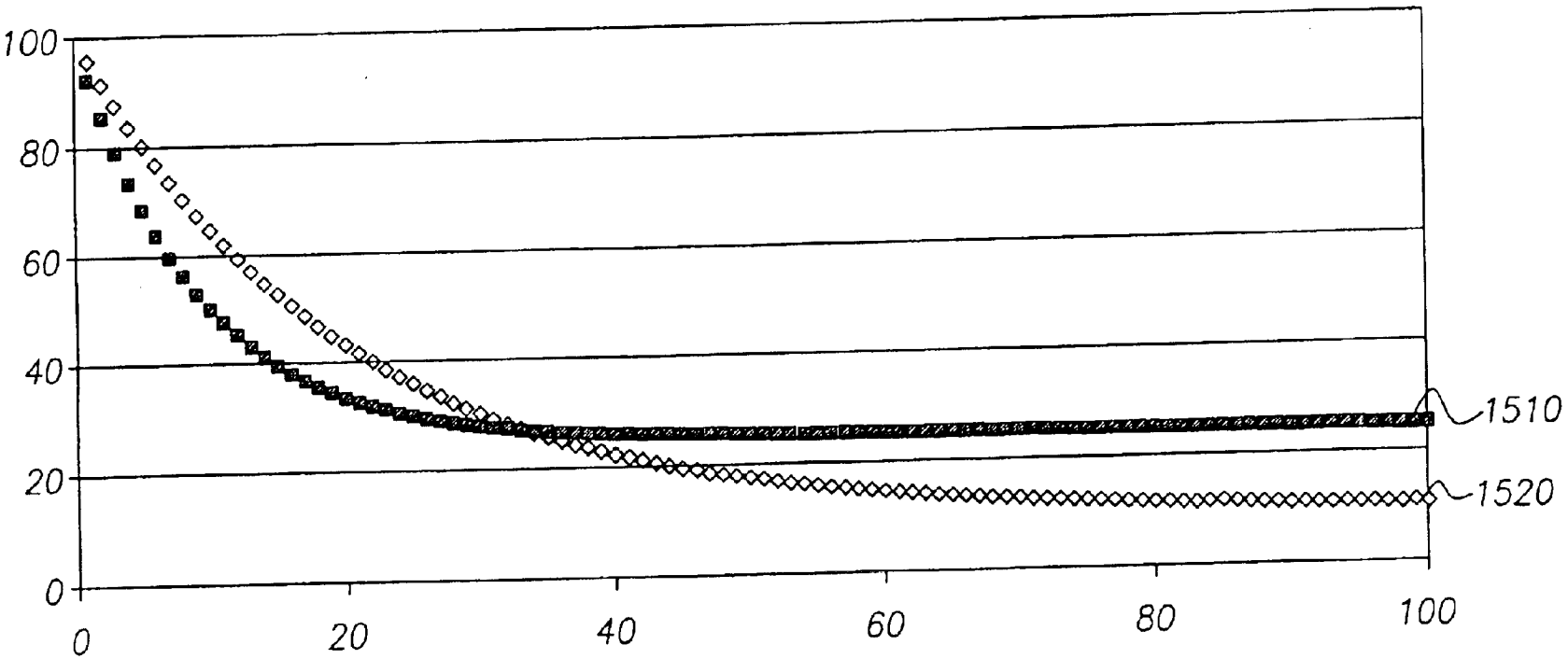
FIG. 15 shows graphically two threshold curves for two recursive services for printhead to determinate the recovery effectiveness of the previous recovery pass.

The thresholds vary for spitting and for priming as can be seen in accordance to FIG. 15, where curve 1510 refers to prime percentage threshold and curve 1520 refers to spit percentage threshold. In the graph of FIG. 15 on the X axis reference is the number of nozzles out before performing a recursive pass, while on the Y axis it is placed the threshold value in terms of percentage of nozzles out which must be recovered to trigger a recursive recovery pass.

The general equation governing these curves 1510, 1520 is:

$$\text{Recovery Percentage}=A*e^{-B(NO)}+C$$

Where A, B and C are determined by a curve fit through various critical points as shown in Table 6 where NO is the number of nozzles out before the recovery pass. In this example, for spitting A=90, B=−0.05, C=10 and for priming A=75, B=−0.11, C=25.

TABLE 6

| Spitting | | Priming | |
|---|---|---|---|
| Nozzles Out | Percentage | Nozzles Out | Percentage |
| 0 | 100 | 0 | 100 |
| 16 | 50 | 10 | 50 |
| Infinity | 10 | Infinity | 25 |

In this embodiment it is not employed a recursive wiping step, but the skilled in the art may appreciate that, similarly, a further curve may be used for defining a Recursive Threshold for Wiping. This value is set to a constant 0.

Maximum Recursive Spitting Cycles is the maximum number of the same spitting pass that can be sequentially performed during a the recovery servicing 1160. This threshold is set to 3 for all the printheads.

Maximum Recursive Wiping Cycles is the maximum number of the same wiping pass that can be sequentially performed during the recovery servicing 1160. This threshold is set to 1 for all the printheads.

Maximum Recursive Priming Cycles is the maximum number of the same priming pass that can be sequentially performed during the recovery servicing 1160. This threshold is set to 2 for all the printheads.

Maximum Total Priming Cycles is the maximum number of priming cycles that can be performed during the life of the printhead. This threshold is set to 35 for each color printhead (CMY) and to 50 for the black printhead.

Referring now to FIG. 12, the recovery servicing procedure will be described in greater detail in connection with a magenta pen, It will be apparent for the skilled in the art how the recovery procedure works with the different pens.

At step 1200 the recovery servicing procedure 1160 starts and will be described assuming that tests 1120 and 1130 identified that the magenta pen needs recovery. At pass 1210 it is selected the magenta printhead.

At pass 1220 a spit servicing command forces the magenta printhead to spit a predetermined amount of ink into its corresponding spittoon 108. For instance the printhead may fire 1000 drops only from the nozzles out at a frequency of 6 kHz and at a temperature of 50 C. (for Cyan pen is 600 drops at 6 kHz and 50C., for Yellow pen is 450 drops at 6 kHz at 50C., for Black pen is 1500 at 2 kHz without pre-warming the printhead), followed by spitting 4 drops from all the nozzles at 10 kHz and 50C. (all the color pen use the same strategy and the black pen fires 15 drops at 10 kHz at 50C.) A drop detection step is performed on the printhead at pass 1230 to check the result of the spit pass. Test 1250 is performed to verify if the percentage of recovered nozzles (total number of nozzles out at the current drop detection divided total number of nozzles out at the previous drop detection) is above the Recursive Threshold Value for the magenta printhead If NOT control passes to test 1300 at FIG. 13. If the result of test 1250 is YES a subsequent test 1260 is executed to verify if the number of spit passes 1220 executed during the current recovery procedure is equal to the Maximum Recursive Spitting Cycles threshold for the magenta pen, i.e. 3.

Test 1260 improves prior art recovery strategies where the recoveries needed to be developed to successfully recover the worst case failure of each type. For example, if some failures would require spitting 500 drops per nozzle to recover and others would require spitting 1500 drops per nozzle, the recovery algorithm would have to be sized to the higher of the two levels to cover both cases. The present recovering procedure, by means of a fast nozzle check implementation, allows for nozzle out checking also within the recovery step.

Thus the printer is able to size the spitting to 500 drops and allow the printer to apply this spitting pass recursively, only as required, to recover the printhead. The result is a recovery strategy which is much less severe for the printhead but which can have a higher efficacy as well.

Returning to test 1260 if the result is YES, the control passes to test 1300, otherwise control passes to test 1240.

Test 1240 verifies if the number of current nozzles out, DDMap [j], are more that the Absolute Spitting Threshold for magenta pen, i.e. 1, AND if the number of current nozzles out which are NOT in the array of the permanent nozzles out, PermMap[j], is more than the Relative Spitting Threshold for the magenta pen, i.e. 2.

If the result of test 1240 is "NO" as opposed to nozzles out, the recovery procedure ends at step 1460, otherwise a new spit pass 1220 is performed again, increasing the number of spit cycles executed in the current recovery, i.e. now 1+1=2, and the flow of steps is followed as before.

Test 1300 verifies if the number of current nozzles out, DDMap [j], are more than the Absolute Wiping Threshold for magenta pen, i.e. 1, AND if the number of current nozzles out which are NOT in the array of the permanent nozzles out, PermMap[j], is more than the Relative Spitting Threshold for the magenta pen, i.e. 2.

If the test 1300 returns "NO" the recovery procedure ends at step 1460, otherwise at pass 1310 a wipe servicing command forces the magenta printhead to be wiped according to a predetermined wiping strategy, increasing the number of wipe cycles executed in the current recovery procedure, i.e. now 0+1=1. For instance The wiping strategy for any color printheads includes spitting 20 drops from all nozzles at 10 kHz and 50C., then perform 2 cycles of bi-directional wipe at a speed of 2 ips (inch per second). Then the magenta pen fires 600 drops (Y pen 600 and C pen 800) from all nozzles at 10 kHz (Y and C pens the same) and 60 C. (Y and C pens at 50C.).

If the pen is black the wipe servicing includes spitting 10 drops from all nozzles at 10 kHz at 50 C., PEG the pen once at a speed of 2 ips and with an hold time of 0.5 sec. Then a wipe from the front to the back of the printhead is performed once at 2 ips speed, followed by a cycle of 3 bi-directional wipes at 2 ips. Then all nozzles spit 200 drops each at 10 kHz at 50 C.

A final spitting step is then performed: color pens fire 5 drops at 10 kHz at 50 C. while a black pen fires 15 drops at 10 kHz at 10 C.

A drop detection step is performed on the printhead at pass 1320 to check the result of the wipe pass. Test 1330 is performed to verify if the percentage of recovered nozzles (total number of nozzles out at the current drop detection divided total number of nozzles out at the previous drop detection) is above the Recursive Threshold Value for the magenta printhead.

If the result of test 1330 is "NO" control passes to test 1400 at FIG. 14. If the result of test 1330 is "YES" a subsequent test 1340 is executed to verify if the number of wipe servicing 1310 executed during the current recovery procedure is equal to the Maximum Recursive Spitting Cycles threshold for the magenta pen, i.e. 1. If the result of test 1340 is YES, the control passes to test 1400, otherwise control passes to test 1300.

Test 1400 verifies if the number of current nozzles out, DDMap [j], are more that the Absolute Priming Threshold for magenta pen, i.e. 4, AND if the number of current nozzles out which are NOT in the array of the permanent nozzles out, PermMap[j], is more than the Relative Priming Threshold for the magenta pen, i.e. 2.

If the test 1400 returns "NO" the recovery procedure ends at steps 1460, otherwise a test 1410 verifies if the total number of primes executed by the current pen, exceed the Maximum Total Priming Cycles for the magenta pen, i.e. 35. If the test return YES the recovery procedure ends at steps 1460, otherwise at pass 1420 a conventional priming servicing command forces the magenta printhead to prime, increasing the number of priming cycles executed in the current recovery procedure, i.e. now 0+1=1, as well as the total priming cycles. A drop detection step is performed on the printhead at pass 1430 to check the result of the prime pass. Test 1440 is performed to verify if the percentage of recovered nozzles (total number of nozzles out at the current drop detection divided total number of nozzles out at the previous drop detection) is above the Recursive Threshold Value for Prime for the magenta printhead.

If the result of test 1440 is "NO" the recovery procedure ends at steps 1460. If the result of test 1440 is YES a subsequent test 1450 is executed to verify if the number of prime servicing 1420 executed during the current recovery procedure is equal to the Maximum Recursive Prime Cycles threshold for the magenta pen, i.e. 2. If the result of test 1340 is YES, the recovery procedure ends at steps 1460, otherwise control passes to test 1400 again.

In the following it is provided how the recovery procedure may work trying to recover a Magenta pen with 32 nozzles out:

DO SPIT RECOVERY Magenta
Drop Detect==20 Nozzles Out
Spit Efficiency=37.5%
Recursive Threshold Spit at 32Nozzles Out=28% (Satisfied)
Spit Cycles=1
Max Cycles=3 (Satisfied)
Absolute Threshold Spit=1 (Satisfied)
Relative Threshold Spit=2 (Satisfied)
SPIT RECOVERY Magenta
Drop Detect=18 Nozzles Out
Spit Efficiency=10%
Recursive Threshold Spit @20NO=43% (Not Satisfied
Absolute Threshold Wipe=1 (Satisfied)
Relative Threshold Wipe=2 (Satisfied)
DO WIPE RECOVERY COLOR
Drop Detect=20 Nozzles Out
Wipe Efficiency=0% (Actually negative but clips at zero)
Absolute Threshold Prime=4 (Satisfied)
Relative Threshold Prime=2 (Satisfied)
#Total Primes=6
Max Primes Allowed Magenta=35 (Satisfied)
PRIME RECOVERY Magenta
Drop Detect=12 Nozzles Out
Prime Efficiency=40%
Recursive Threshold Prime @20NO=33% (Satisfied)
#Prime Cycles=1
#Max Recursive Prime Cycles=2 (Satisfied)
Absolute Threshold Prime=4 (Satisfied)
Relative Threshold Prime=2 (Satisfied)
#Total Primes=7
Max Primes Allowed Magenta=35 (Satisfied)
PRIME RECOVERY Magenta
Drop Detect=6 Nozzles Out
Prime Efficiency=50%
Recursive Threshold Prime @12NO=45% (Satisfied)
#Prime Cycles=2
#Max Recursive Prime Cycles=2 (Not Satisfied)
LEAVE RECOVERY ALGORITHM FOR PRINTING The skilled in the art may appreciate that the same nozzle health historical information gathered as previously described can be reused for a number of different applications. For instance it would be possible to use this information for detecting the end of life of an off-axis pen or for providing a more reliable error hiding technique.

In accordance to a second embodiment of the invention, the end of life of a printhead is reached when DDnth value will be at least equal or bigger than the End of Life Threshold which in this embodiment is 5 for a black printhead and 8 for a color printhead.

Figure 16:
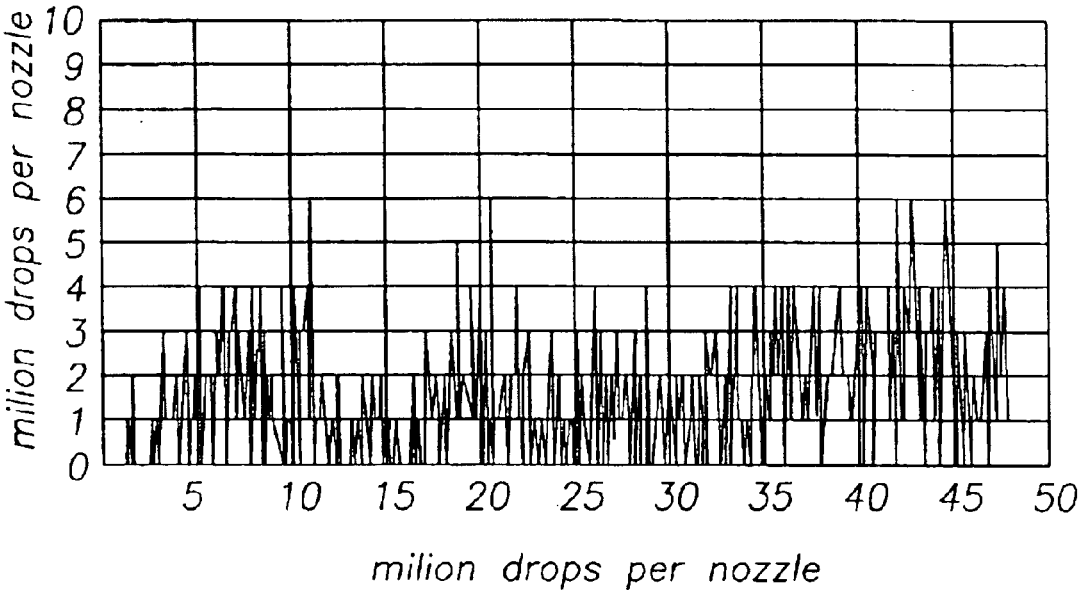
FIGS. 16 and 17 show the number of nozzles out as detected according to a know technique and according to the a specific method of the present invention.
Figure 17:
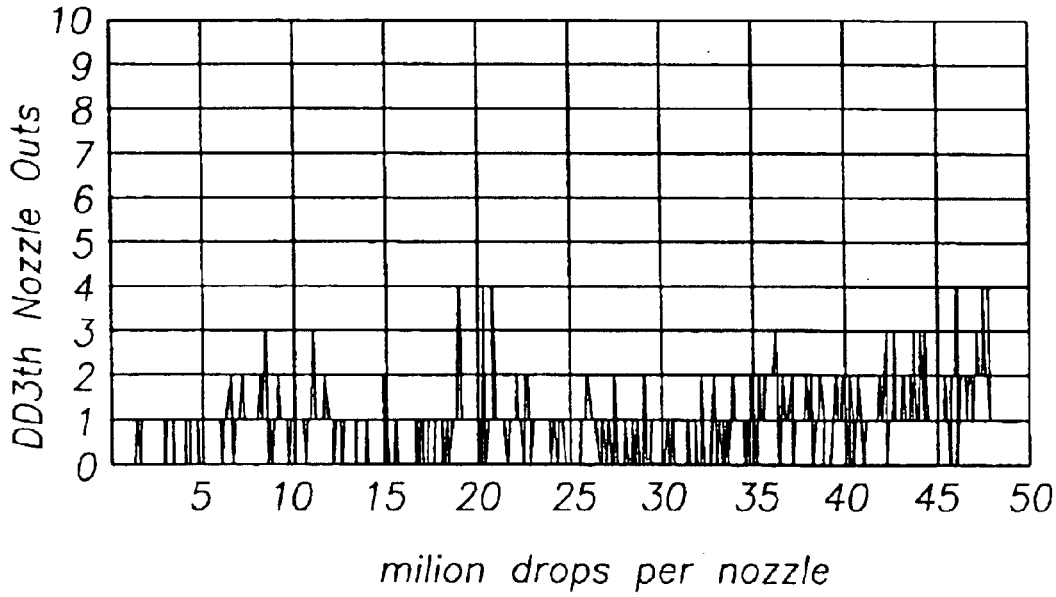

After some tests the Applicant has observed that the result of a single drop detection step may not provide a real picture of the trend on the functionality of a pen. FIG. 16 shows how may vary the numbers of nozzles out detected, reporting each drop detection measured, based on the usage of the pen (number of drops fired). In FIG. 17 it is shown how considering DD3rd as the number of nozzle out detected for each drop detection provides a clearer picture of the variation of the capabilities of the pen. It should also be noted that DD3rd is increasing and approaching the End of Live Threshold after about 50 million drops per nozzle. The skilled in the art should appreciate how, according to FIG. 16, the first time that the actual number of nozzles out detected is over the End of Life threshold is only after 10 million of drops per nozzles. This is well in advance respect to 50 million drops as registered by the more realistic measurement here described.

When the printhead reaches this level, the printer warns the user to replace the offending pen without stopping printing. The pen is permanently marked also in the Acumen of the pen (using one bit), so moving this pen to a different printer will produce the same result. When the pen is flagged to be at the end of life and whenever user's print quality demand is "normal" (not fast or best), printer will use a "back-up print mode", which means automatically switching to a higher number of passes to provide better error hiding capability, more necessary for a pen having an high number of failing nozzles, i.e. to be replaced (hide) by other nozzles. By doing this, printer will assure the minimum acceptable print quality in normal mode by trading off productivity (throughput). Printer will work this way until a new pen replaces the end of life pen.

If user doesn't replace the end of life pen and if printhead nozzle health keeps degrading, we protect the print quality delivered by the printer by adding a higher end of life level threshold, TooManyNozzleOuts which is set at 30 nozzle outs. Advantageously when DDth is bigger than TooManyNozzleOuts threshold, the printer stops printing and asks the user to replace the pen or to continue. In fact there is a risk now to perform a non-effective error hiding and so to cause a waste of costly media if the printing is continued without any warning. Another bit it is used in the acumen to mark this state of the pen.

The above process for detecting the end of life of a pen will help to resolve a number of problems generated by the allowing the pen to fire a non predetermined quantity of ink, differently from most of the prior art pens having the life fixed with the volume of ink available in the reservoir or in the printhead cartridge In the DesignJet © 750 C printers an end of life message is presented to the user when at least one nozzles results was not successfully recovered by the recovery procedure. This solution presents the following disadvantages:

- Printhead transient problems will count as failures. An example of this could be a paper crash that produces a transient problem but the system is able to clear the nozzles after some plots or a few recovery cycles;
- Stopping printing at this point and asking for replacement is against the unattendedness and networkability objective of the printer;
- In addition, users may not have immediately available a new printhead to is replace the failing one.

HP Professional Series 2000C printers produced by Hewlett-Packard Company, of Palo Alto, Calif. use the change of printhead thermal characteristics to detect when the standpipe fills of air, and thus is approaching end of life. But this method takes into account only the failure mode associated with air in the pen, and not issues related to nozzle health, which are usually more generic. To encompass the rest of failure modes, this printer also uses drop counting for End of Life "detection": when pen bas fired a certain number of drops, printer advises user to get a new printhead. The main drawback of drop counting is that when the printer warns the user, the printhead may be working still well and a replacement would not be advisable.

With reference to FIG. 3 an example of an improved error hiding technique based on nozzle health historical information gathered during a number of drop detection steps will be described, in accordance to a third embodiment of the present invention.

It is known to use error hiding to improve the print quality. In EP patent application no. 98301559.5 it is describe a technique which use a pattern based nozzle health detection technique, based on a LED line sensor mounted on the pen carriage which reads a printed pattern to find misdirected or missing dots corresponding to nozzles out, weak and some kinds of misdirection.

This technique is executed each certain number of plots and apply error hiding on the failing nozzles. However, this approach has some limitations:

- It is slow and this limits the number of times that it is possible to perform without heavily affecting throughput and printer productivity. This means that the result of a single detection will be used for several plots with the risk of printhead nozzle health changing over time.
- Only the most recent detection is used, making impossible adjusting the error hiding strategy to printhead nozzle health dynamic variations, such as internal contaminants moving inside the nozzles, air accumulation, nozzle plate dirtiness, head crashes (printhead touching media while printing), external contaminants moving on the nozzle plate, or the like.
- Each cycle of the technique implies a certain waste of media or a media is change since cannot successfully work on all media.

In addition to the previous definitions already described for maintaining historical health information on nozzles, the following definitions also will be used in this embodiment.

Dnozzi: this array contains the results of the last eight drop detections for the with nozzle.

Dnozzi[7] contains the result of the more recent drop detections

Dnozzi[0] contains the result of eight usable drop detects ago.

For the sake of clarity DDMap and Dnozzi has been described independently but both contains the same information. Each DDmap vector contains the data for each nozzle according to a single drop detection, while each Dnozzi contains the data for a single nozzle according to all the usable drop detections. Thus according to the various examples system comprising a pen having 524 nozzles which wants to maintain a history of 8 drop detections needs 524 Dnozzi[8] vectors and 8 DDMap[524] vectors b: contains the factor for weighting the historical result of the usable drop detection, i.e. a value which allows to emphasise measurements related either to more recent drop detections (when b contains bigger values) or to older drop detections (if b contains smaller values).

W: is a function able to calculate the weight of a given historical drop detection array Dnozzi[ ].

W is defined as $$W(Dnozzi[]) = \sum_{i=0}^{7} Dnozzi[i] \cdot b^i$$

W is then normalised to obtain a function w in the [0 . . . 1] range which correspond to a distribution of probability.

$$w(Dnozzi[]) = \frac{W(Dnozzi[])}{W(\{1, 1, 1, 1, 1, 1, 1, 1\})} = \frac{\sum_{i=0}^{7} Dnozzi[i] \cdot b^i}{\sum_{i=0}^{7} b^i}$$

Thus w attempts to predict the probability that the ith nozzle would pass the next drop detection, i.e. would fire properly. In order to do so the value of b is chosen by using its maximum likelihood estimator for the w distribution.

With reference to FIGS. 3A to 3D, it is shown how the value of w changes for one nozzle after every drop detection, where each figure refers to the same nozzle history but applying a different values for the basis b.

Figure 3A:
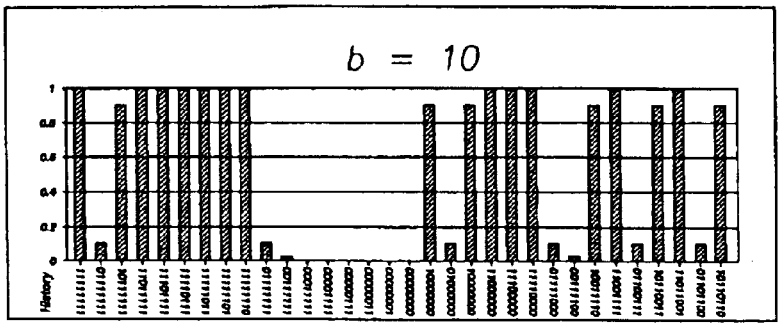
FIGS. 3A–3D are diagrams showing how the probability of finding a nozzle not working vary according to its health history and to 4 different weighting basis.

In FIG. 3A b is equal to 10 and it is shown how the more recent 1–2 detection are considerably affecting the weight result.

Figure 3B:
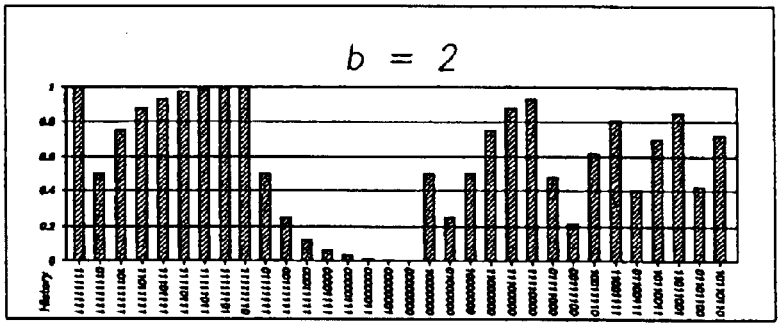

In FIG. 3B b is equal to 2, i.e. the weight of the last detection is bigger than the sum of the weight of all the previous detection. Thus, a non-working nozzle which has fired only once but during the last drop detect is weight more than a nozzle which is always firing but has failed during the last drop detection.

Experiments run by the applicant have shown that the second nozzle is more reliable of the first one.

Figure 3C:
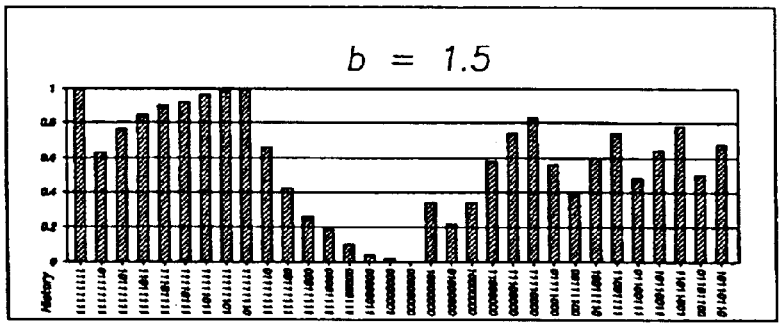

In FIG. 3C b is equal to 1.5 in order to take more into account the history of the nozzle.

Figure 3D:
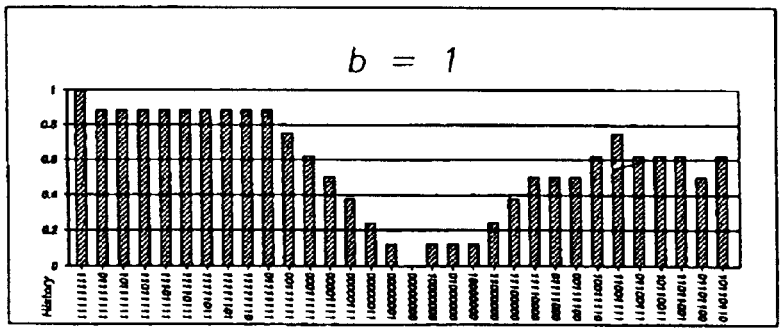

In FIG. 3D b is equal to 1, thus all the drop detection has the same history.

For each example the following history for the nozzle has been used, wherein 1 is correspond to working and 0 to failing:

Initial history {1, 1, 1, 1, 1, 1, 1, 1}

History: 0, 1, 1, 1, 1, 1, 1, 1, 0, 0, 0, 0, 0, 0, 0, 0, 1, 0, 1, 1, 1, 1, 0, 0, 1, 1, 0, 1, 1, 0, 1

The values reported on the X axis correspond to blocks of 8 consecutive historical result starting from the initial history {1, 1, 1, 1, 1, 1, 1, 1) and permuting the values according to the History up to the more recent block {1, 0, 1, 1, 0, 1, 1, 0).

Extended test run by Applicant have shown that within a preferred range of values for the weight factor b included between 1 and 2 all of which are capable of providing a reliable estimation of the probability that the nozle will work the next time it is fired, the better values are between 1.4 and 1.6, preferably 1.5, all of which are capable of providing a more realistic picture of the status of the nozzle.

Error hiding problems depends mainly on two error: a) wrong nozzle identification, i.e. the nozzle identified as failing is actually working, so there was non need to replace it; b) wrong nozzle replacement, i.e. the nozzle selected for replacement is actually non-working.

In the following will be described a probabilistic technique to determine if a nozzle should be replaced and by which other nozzle.

To determine if a nozzle should be replaced, the probability that it will fail the next drop detection is compared with a threshold, in this embodiment the value is 0. The estimation of this probability is obtained by means of the w function, i.e. 1-w would be the probability-to-fail score and this value will be used to identify the nozzle to be replaced.

Usually, error hiding implies a multi-pass printmode, even if there are techniques for performing error hiding even with one-pass print modes. In the following it will be described how this technique is working with a multi-pass printmode and while the skilled in the art may appreciate that the same technique will work using the same principles in single-pass printmodes.

The concept of printmodes is a useful and well known technique of laying down in each pass of the pen only a fraction of the total in required in each section of the image, so that any areas left white in each pass are filled in by one or more later passes. This tends to control bleed, blocking and cockle by reducing the amount of liquid that is on page at any given time.

The specific partial-inking pattern employed in each pass, and the way in which these different patterns add up to a single fully inked image is known as a printmode. For instance a one-pass mode is one in which all dots to be fired on a given row of dots are placed on the medium in one swath of the printhead, and than the print medium is advanced into position for the next swath.

A two-pass mode is a print pattern wherein one-half of the dots available in a given row of available dots per swath are printed on each pass of the printhead, so two passes are needed to complete the printing for a given row. Similarly, a four pass mode is a print pattern wherein one forth of the dots for a given row are printed on each pass of the printhead, so four passes are needed to complete the printing for a given row.

The patter used in printing each nozzle section is known as the "printmode mask" or "printmask" or sometime just "mask". A printmask is a binary pattern that determines exactly which ink drops are printed in a given pass or, to put the same thing in another way, which passes are used to print a each pixel. The printmask is thus used to "mix up" the nozzle used, as between passes, in such a way as to reduce undesirable printing artefacts.

EP application No 98301559.5 describes how to work with a plurality of selected print mask in order to implement error hiding in multipass print modes and the same technique may be used also in this case.

In the following will be described how to modify the masks for a given print mode in accordance to the probability that certain nozzles may fail to perform error hiding.

For the sake of clarity in the following example the following assumption will be done: a) printhead have four nozzles only, and 2) a four-pass 25% density interlaced printmode are used c) 4 bit masks are used.

Table 7 shows the standard print mask for the used printmode. The columns are the four nozzles of the pen and the rows are the four passes of the printmode. In addition, the cells contain a binary number meaning when the nozzle will fire for a given pass. The mask chosen are simple: in pass 0 all nozzles fire only every 4th dot, in pass 1 they fire every $3^{rd}$ dot, and so on.

TABLE 7

| | N0 | N1 | N2 | N3 |
|---|---|---|---|---|
| Pass 1 | 0001 | 0001 | 0001 | 0001 |
| Pass 2 | 0010 | 0010 | 0010 | 0010 |
| Pass 3 | 0100 | 0100 | 0100 | 0100 |
| Pass 4 | 1000 | 1000 | 1000 | 1000 |

At this point the different error hiding alternatives for this print mode shall be considered. Each alternative is a group of 4 element and the ith element of the group is the replacement for the ith pass. For instance the group {2, 4, 1, 3) means that the malfunctioning nozzles of pass 1 are to be replaced by nozzles of pass 2, malfunctioning nozzles of pass 2 by nozzles of pass 4, malfunctioning nozzles of pass 3 by nozzles of pass 1 and malfunctioning nozzles of pass 4 by nozzles of pass 3.

Instead of evaluating each possible alternative, the example will consider only two replacement alternatives: {2, 3, 4, 1} and {3, 4, 1, 2}

The estimated probabilities (calculated as previously described using b=1.5 and the result of the most recent drop detections) for each nozzle to be found working are: N0=0.4, N1=0.7, N2=1, N3=1.

Figure 18:
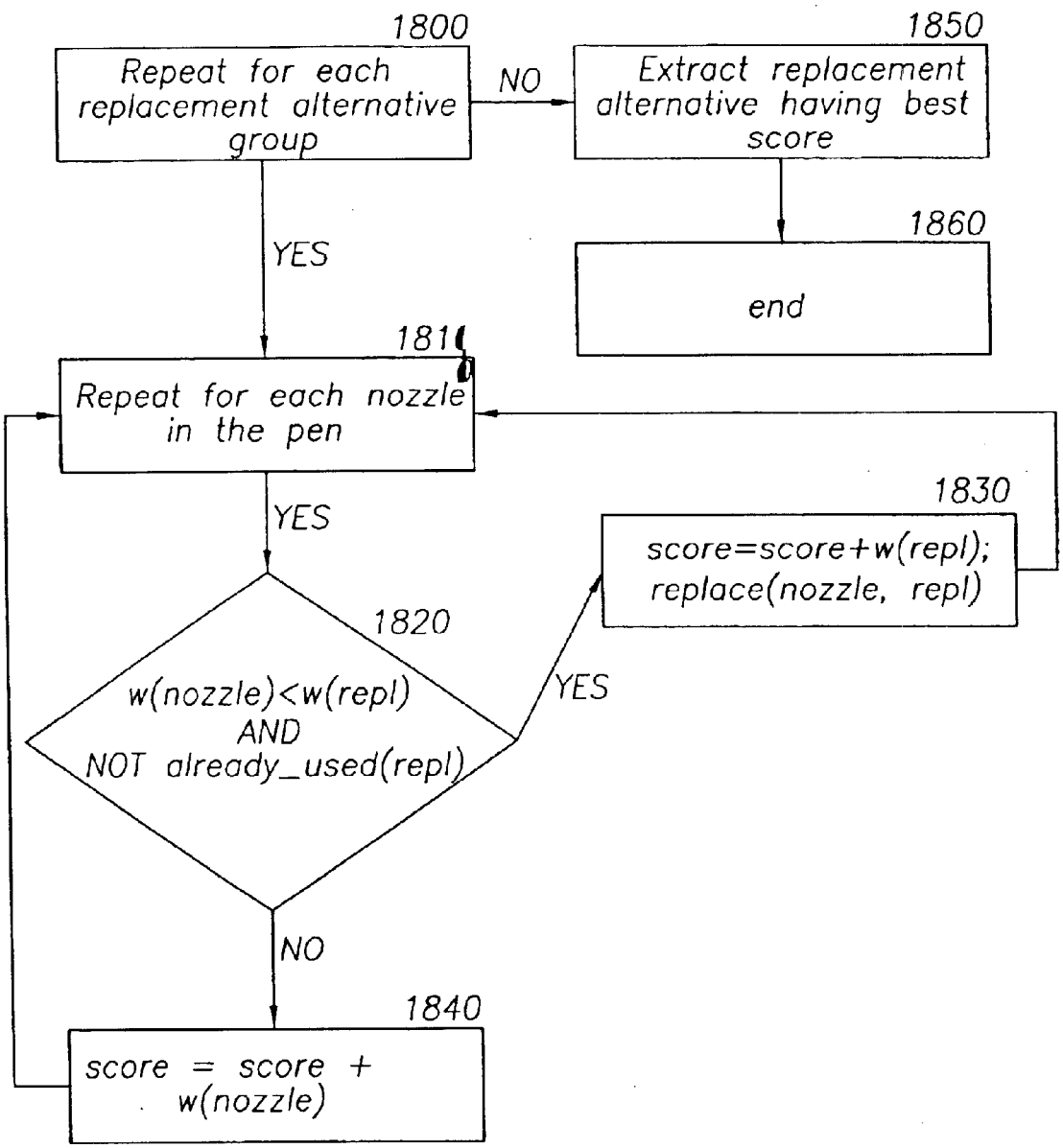
FIG. 18 illustrates schematically steps involved in nozzles error hiding according to a specific method of the present invention.

The technique weights each of the possible alternatives according the algorithm as will be described in accordance with FIG. 18. This process will try to select the alternative using the number of nozzles (original or replaced) having the bigger probably to work, as a whole.

The process start at step 1800, which for each of the possible replacement alternatives step 1810 is repeated.

At step 1810, for each nozzle of the pen test 1820, and steps 1830 or 1840 are repeated. Test 1820 verify whether the weight of said nozzle is smaller that the weight of the replacement nozzle, i.e. the replacement nozzle would more likely work better of the originally designated nozzle, AND if the replacement nozzle is still available, i.e. the replacement nozzle is not already in use for firing as an original nozzle.

If the result of the test is YES the score is increased of the a value equal to the weight of the replaced nozzle and the nozzle is considered replaced; otherwise the score is increased of the a value equal to the weight of the original nozzle. When the iteration 1810 ends score will contain a value corresponding to the quality of the first replacement alternative, in terms of sum of the probability of working of each nozzle (original or replaced) in this group.

Iteration 1810 will now start again to calculate the score of the next replacement alternative, and it will be repeated until all the replacement alternatives are evaluated. At step

1850 the process extract the replacement alternative with the best score and ends at step 1860 returning the elected replacement alternative to a know error hiding process to perform the error hiding in accordance with the proposed replacement.

If this process is applied on the above example option 1 {2, 3, 4, 1} will score:

1+1+0.7+1=3.7 while option 2 will score

1+1+1+1=4

Thus Option 2 will be elected to generate an updated printing masks as follow in table 9:

TABLE 9

| | N0 | N1 | N2 | N3 |
|---|---|---|---|---|
| Pass 1 | 0000 | 0000 | 0101 | 0101 |
| Pass 2 | 0000 | 0000 | 1010 | 1010 |
| Pass 3 | 0000 | 0000 | 0101 | 0101 |
| Pass 4 | 0000 | 0000 | 1010 | 1010 |

The result is that the two nozzles N0 and N1 having the higher probability of failing has been correctly replaced by the ones having higher probability of working.

What is claimed is:

1. An inkjet printing device for placing droplets of ink on a medium, comprising:

a pen comprising a printhead having a plurality of nozzles for ejecting droplets of ink, a droplet detector for identifying the nozzles of the printhead which currently present some malfunction in ejecting droplets of ink, and a memory means for storing for each nozzle of the plurality of nozzles a history of the malfunction identified by performing droplet detections, said history being used by the device to alleviate problems caused by malfunctioning nozzles.

2. The device as claimed in claim 1, further comprising a servicing means for recovering the defective nozzles, said history being used by the servicing means for selecting an appropriate servicing strategy.

3. The device as claimed in claim 1, further comprising an error hiding means for hiding malfunctioning nozzles, said history being used by the error hiding means to attempt to select a working replacement nozzle for at least one of the malfunctioning nozzles, which currently present a malfunction in ejecting droplets of ink.

4. An inkjet printing device for placing droplets of ink on a medium, comprising:

a pen comprising a printhead having a plurality of nozzles for ejecting droplets of ink, a droplet detector for identifying the nozzles of the printhead which currently present some malfunction in ejecting droplets of ink, and a memory for storing for at least one of the nozzles of the plurality of nozzles a history of the malfunction identified by said droplet detector.

5. The device as claimed in claim 4, further comprising a servicing station for recovering the defective nozzles, said history being used by the servicing station for selecting an appropriate servicing strategy.

6. The device as claimed in claim 4, further comprising a nozzle-replacement mechanism for replacing malfunctioning nozzles with working nozzles, said history being used by the nozzle-replacement mechanism to attempt to select a working replacement nozzle for at least one of the malfunctioning nozzles, which currently present a malfunction in ejecting droplets of ink.

* * * * *